US008279017B2

(12) United States Patent
Hasegawa

(10) Patent No.: US 8,279,017 B2
(45) Date of Patent: Oct. 2, 2012

(54) MAGNETIC RESONANCE TYPE ISOLATOR

(75) Inventor: Takashi Hasegawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/222,004

(22) Filed: Aug. 31, 2011

(65) Prior Publication Data

US 2012/0056690 A1 Mar. 8, 2012

(30) Foreign Application Priority Data

Sep. 3, 2010 (JP) ..... 2010-197353

(51) Int. Cl.
*H01P 1/32* (2006.01)

(52) U.S. Cl. ..... 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,560,892 | A * | 2/1971 | Chiron | 333/1.1 |
| 3,835,420 | A * | 9/1974 | Orime et al. | 333/24.2 |

FOREIGN PATENT DOCUMENTS

| | | | |
|---|---|---|---|
| EP | 1 119 111 | A1 | 7/2001 |
| JP | 63-260201 | A | 10/1988 |
| JP | 2001-326504 | A | 11/2001 |
| JP | 2004-289301 | A | 10/2004 |
| JP | 2006-135450 | A | 5/2006 |
| WO | 01/10047 | A1 | 2/2001 |

OTHER PUBLICATIONS

Hasegawa; "Magnetic Resonance Type Isolator"; U.S. Appl. No. 13/,222,006, filed Aug. 31, 2011.

* cited by examiner

*Primary Examiner* — Stephen Jones
(74) *Attorney, Agent, or Firm* — Keating & Bennett, LLP

(57) ABSTRACT

A magnetic resonance type isolator includes a ferrite; a connection conductor that is arranged on the ferrite and includes a first port, a second port and a third port; a permanent magnet that applies a direct current magnetic field to the ferrite; an inductor that defines a reactance element; and capacitors that define an impedance matching circuit. A main line arranged between the first port and the second port of the connection conductor does not resonate, an end portion of a sub-line that branches from the main line serves as the third port, and a wave reflected from the sub-line is modulated so that its phase is shifted by 90° or about 90° at an intersection of the connection conductor. The inductor is connected to the third port and the capacitors are connected to the first and second ports, respectively.

8 Claims, 32 Drawing Sheets

MAGNETIC RESONANCE TYPE ISOLATOR

BACKGROUND OF THE INVENTION

1. Field of the Invention

The present invention relates to magnetic resonance type isolators and in particular, relates to magnetic resonance type isolators that are, for example, used in a microwave frequency band.

2. Description of the Related Art

Typically, isolators have a characteristic of only transmitting signals in a specific direction and not transmitting signals in the opposite direction. Isolators are included in transmission circuit units of mobile communication devices such as cellular phones. Known examples of magnetic resonance type isolators include those described in Japanese Unexamined Patent Application Publication Nos. 63-260201 and 2001-326504. Magnetic resonance type isolators utilize a phenomenon that occurs in which, when high-frequency currents that have the same amplitude but differ in phase by about ¼ of a wavelength flow through two orthogonal lines (having four ports), a magnetic field (circularly polarized wave) is generated at the intersection of the two lines, and the circulation direction of the circularly polarized wave is reversed in accordance with the progression directions of the electromagnetic waves of the two lines. That is, a ferrite is arranged at an intersection of two lines and a static magnetic field is applied, which is necessary for magnetic resonance, by using a permanent magnet, and accordingly a positively circularly polarized wave or a negatively circularly polarized wave is generated by a wave being reflected from a sub-line in accordance with the propagation direction of an electromagnetic wave propagating along a main line. If a positively circularly polarized wave is generated, a signal is absorbed by the magnetic resonance of the ferrite, whereas if a negatively circularly polarized wave is generated, magnetic resonance does not occur and the signal passes through. A reactance element, which causes a signal to be reflected, is connected to an end portion of the sub-line.

However, to date, magnetic resonance type isolators have had a main line having a length of about ¼ of a wavelength so that the main line would resonate and have included two reactance elements, and consequently have had a large size of, for example, 20 mm by 20 mm for a frequency of about 2 GHz. This is not compatible with the current situation in which mobile communication devices have been becoming increasingly smaller in recent years and the density with which components thereof are mounted has been becoming increasingly high. Furthermore, in the case where a power amplifier is connected to the input side, it is preferable that the impedance on the input side be low and it is preferable that the impedance on the output side be higher than that on the input side. However, to date, in magnetic resonance type isolators, these requirements have not been satisfied and it has been necessary to provide an additional impedance conversion device as a separate component.

SUMMARY OF THE INVENTION

Accordingly, preferred embodiments of the present invention provide a magnetic resonance type isolator that has a significantly reduced size and has a low impedance.

A magnetic resonance type isolator according to a first preferred embodiment includes a ferrite; a connection conductor that is arranged on the ferrite and includes a first port, a second port and a third port; and a permanent magnet that applies a direct current magnetic field to the ferrite. A main line arranged between the first port and the second port of the connection conductor does not resonate, an end portion of a sub-line that branches from the main line serves as the third port, a reactance element is connected to the third port and the reactance element is connected to the ground. An impedance matching circuit is connected to the first port and the second port.

In the magnetic resonance type isolator according to the first preferred embodiment, a wave reflected from the sub-line to which the reactance element is connected is modulated such that its phase is shifted by 90° or about 90° at the intersection of the connection conductor with respect to waves incident from the first and second ports. Thus, a positively or negatively circularly polarized wave is generated at the intersection. A signal is absorbed or is allowed to pass in accordance with generation of a positively or negatively circularly polarized wave as in the related art. In the magnetic resonance isolator, the main line does not resonate and therefore it is possible to reduce the length of the main line to be equal to or less than about ¼ of the wavelength and since the magnetic resonance type isolator preferably includes three ports, it is sufficient to use only a single reactance element. Thus, a magnetic resonance type isolator that is very compact and has a low impedance can be provided. Moreover, an impedance matching circuit is connected to the first port and the second port and therefore the impedance of a device on the input side and the impedance of a device on the output side can be made to match each other. Therefore, it is not necessary to add an impedance conversion device as a separate component and such a component of an impedance conversion circuit can be omitted.

A magnetic resonance type isolator according to a second preferred embodiment includes a ferrite including a first main surface and a second main surface that oppose each other; a connection conductor that is arranged on the first main surface of the ferrite and includes a first port, a second port and a third port; and a permanent magnet that applies a direct current magnetic field to the ferrite. A main line arranged between the first port and the second port of the connection conductor does not resonate, a sub-line that branches from the main line serves as an opposing conductor that extends in a direction perpendicular or substantially perpendicular to the main line onto the second main surface, an end portion of the opposing conductor serves as the third port, a reactance element is connected to the third port and the reactance element is connected to the ground. An impedance matching circuit is connected to the first port and the second port.

The operational principle and the operational advantages of the magnetic resonance type isolator of the second preferred embodiment are the same as those of the magnetic resonance type isolator according to the first preferred embodiment. In the magnetic resonance type isolator according to the second preferred embodiment, the opposing conductor that extends in a direction that is perpendicular or substantially perpendicular to the main line on the second main surface of the ferrite is arranged so as to extend from the sub-line, and therefore a high frequency magnetic field is confined to the ferrite due to the opposing conductor, leakage of the magnetic flux is small and the insertion loss is improved.

According to various preferred embodiments of the present invention, a magnetic resonance type isolator that achieves a significantly reduced size and has a low impedance is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereafter, preferred embodiments of a magnetic resonance type isolator according to the present invention will be described with reference to the accompanying drawings. In each of the drawings, like components and portions will be denoted by the same symbols and repeated description thereof will be avoided. Furthermore, in each of the drawings, portions that are shaded with diagonal lines indicate conductors.

First Preferred Embodiment

A magnetic resonance type isolator 1A according to a first preferred embodiment will be described hereafter with reference to FIGS. 1 to 5D.

Figure 1:
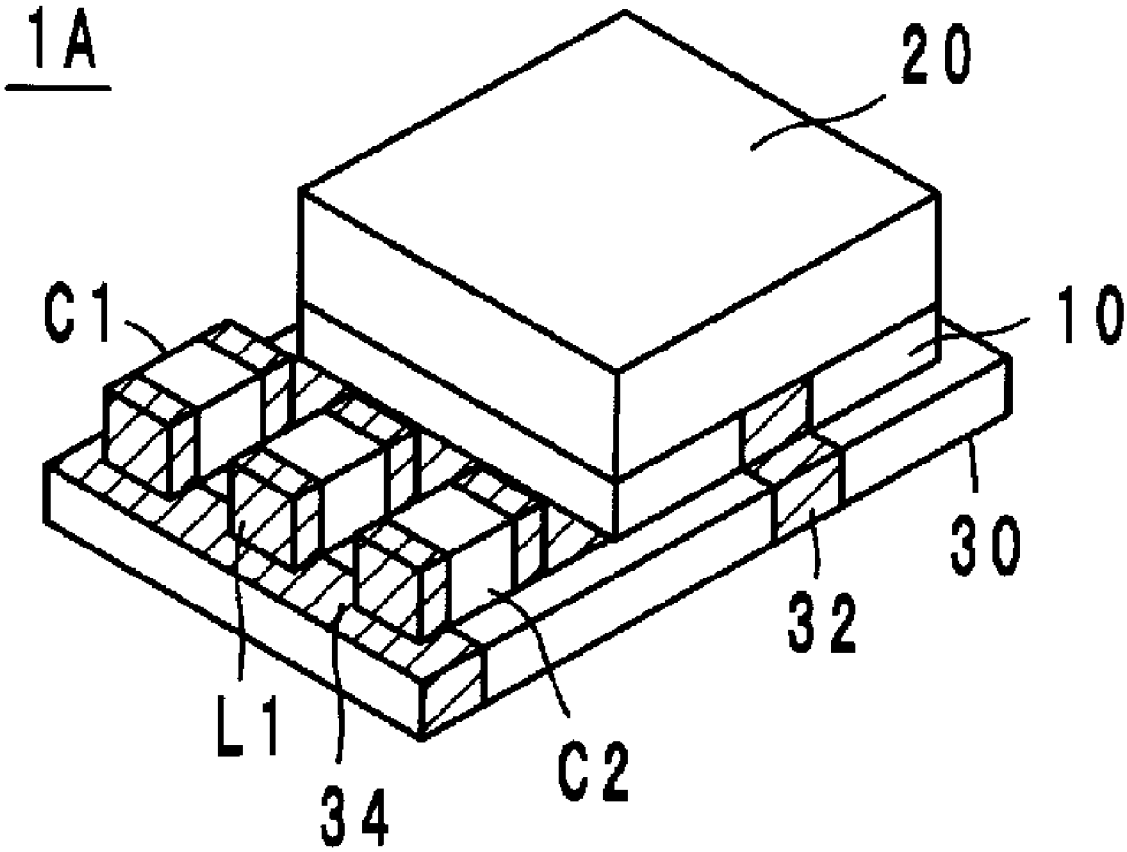
FIG. 1 is a perspective view illustrating a magnetic resonance type isolator according to a first preferred embodiment of the present invention.
Figure 2:
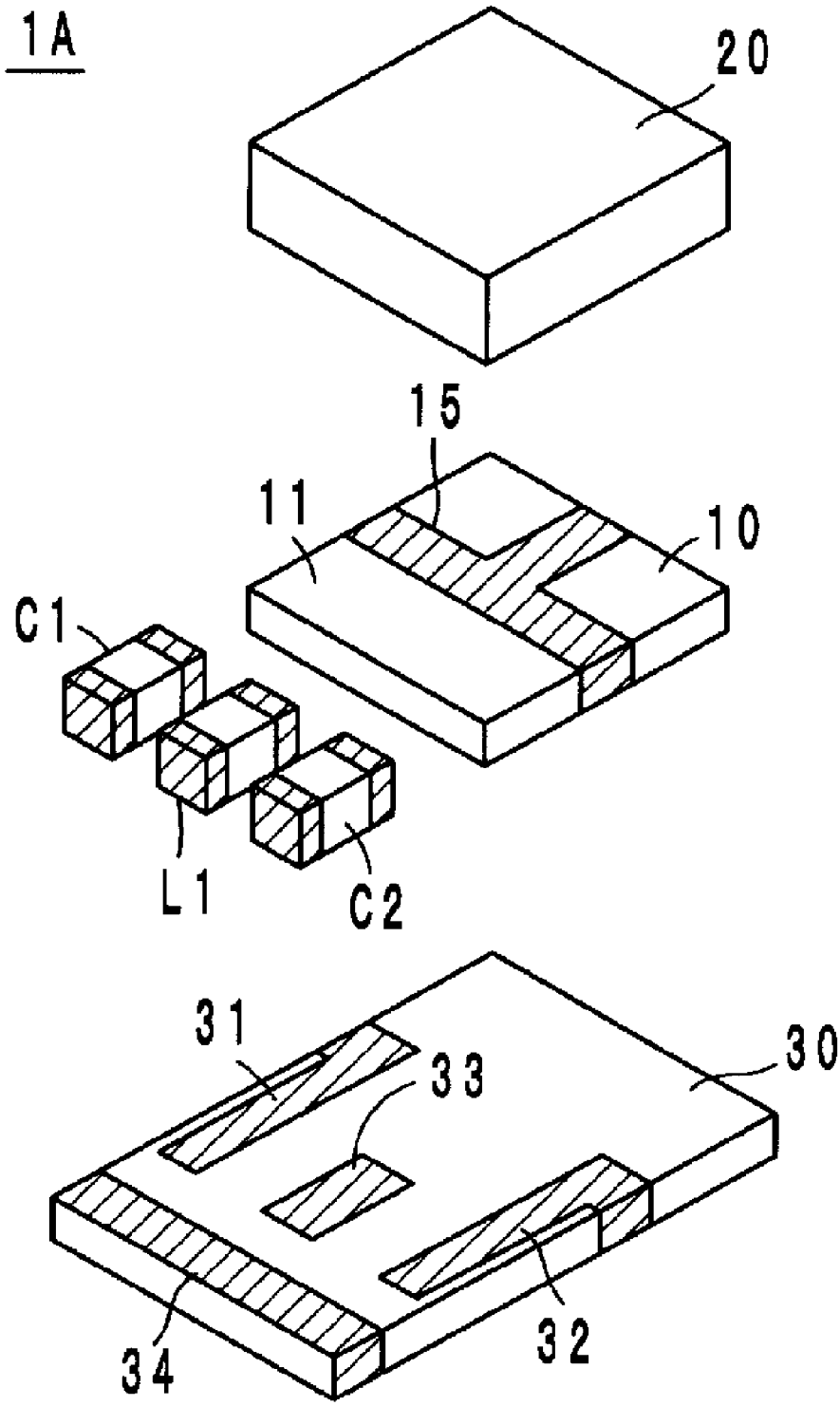
FIG. 2 is an exploded perspective view illustrating the magnetic resonance type isolator according to the first preferred embodiment of the present invention.

As illustrated in FIGS. 1 and 2, the magnetic resonance type isolator 1A according to the first preferred embodiment includes a ferrite 10, a connection conductor 15 including three ports P1, P2 and P3 that form an inverted T shape arranged on a first main surface 11 of the ferrite 10, a permanent magnet 20 that applies a direct current magnetic field to the ferrite 10, an inductor L1 that serves as a reactance element, capacitors C1 and C2 that function as an impedance matching circuit, and a mounting substrate 30.

Figure 3A:
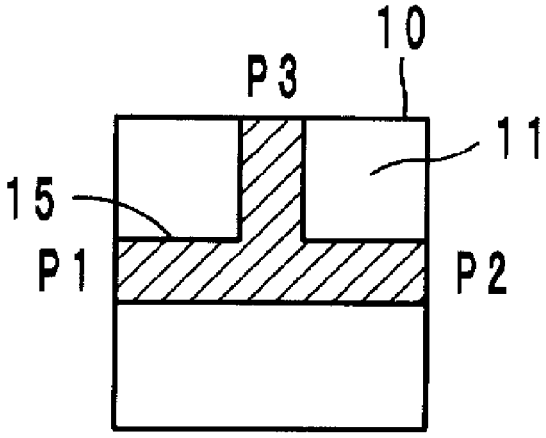
FIG. 3A and FIG. 3B are respectively a top surface view and a bottom surface view of a ferrite of the magnetic resonance type isolator according to the first preferred embodiment of the present invention.
Figure 3B:
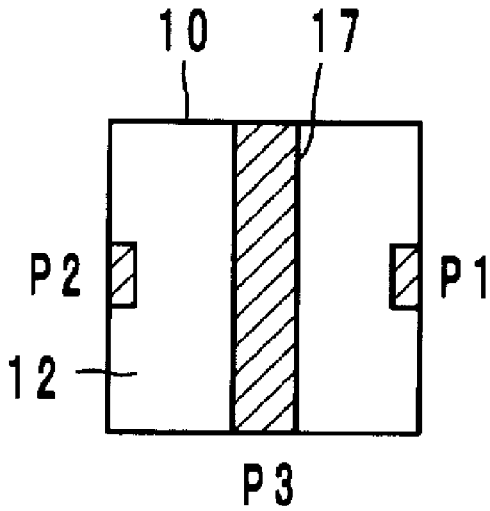

The connection conductor 15 preferably is a thin film formed by, for example, deposition of a conductive metal or is a thick film formed by applying and baking a conductive paste. As illustrated in FIGS. 3A and 3B, a main line, which is arranged between the first port P1 and the second port P2 that face each other along a straight line, among the three ports P1, P2 and P3 of the connection conductor 15, preferably has a line length of about ¼ of the wavelength or less so as not to resonate. On the first main surface 11, a sub-line that branches from the main line of the connection conductor 15 extends in a direction that is perpendicular or substantially perpendicular to the main line onto a second surface 12 and serves as an opposing conductor 17, and an end portion of the opposing conductor 17 serves as the third port P3. Here, the term "main line" refers to a conductor that extends between the first port P1 and the second port P2 and the term "sub-line" refers to a conductor that branches off from a central portion of the main line and extends to the third port P3.

An input terminal electrode 31, an output terminal electrode 32, a relay terminal electrode 33 and a ground terminal electrode 34 are provided on the mounting substrate 30. The ferrite 10 and the permanent magnet 20 preferably have the same surface area and are mounted on the mounting substrate 30 in a state where the permanent magnet 20 is adhered to the first main surface 11 of the ferrite 10. At this time, one end of the main line (first port P1) is connected to the input terminal electrode 31, the other end of the main line (second port P2) is connected to the output terminal electrode 32 and an end portion of the sub-line (third port P3) is connected to the relay terminal electrode 33. One end of the inductor L1 is connected to the relay terminal electrode 33 and the other end of the inductor L1 is connected to the ground terminal electrode 34. One end of the capacitor C1 is connected to the first port P1 and the other end of the capacitor C1 is connected to the ground terminal electrode 34. One end of the capacitor C2 is connected to the second port P2 and the other end of the capacitor C2 is connected to the ground terminal electrode 34.

Figure 4:
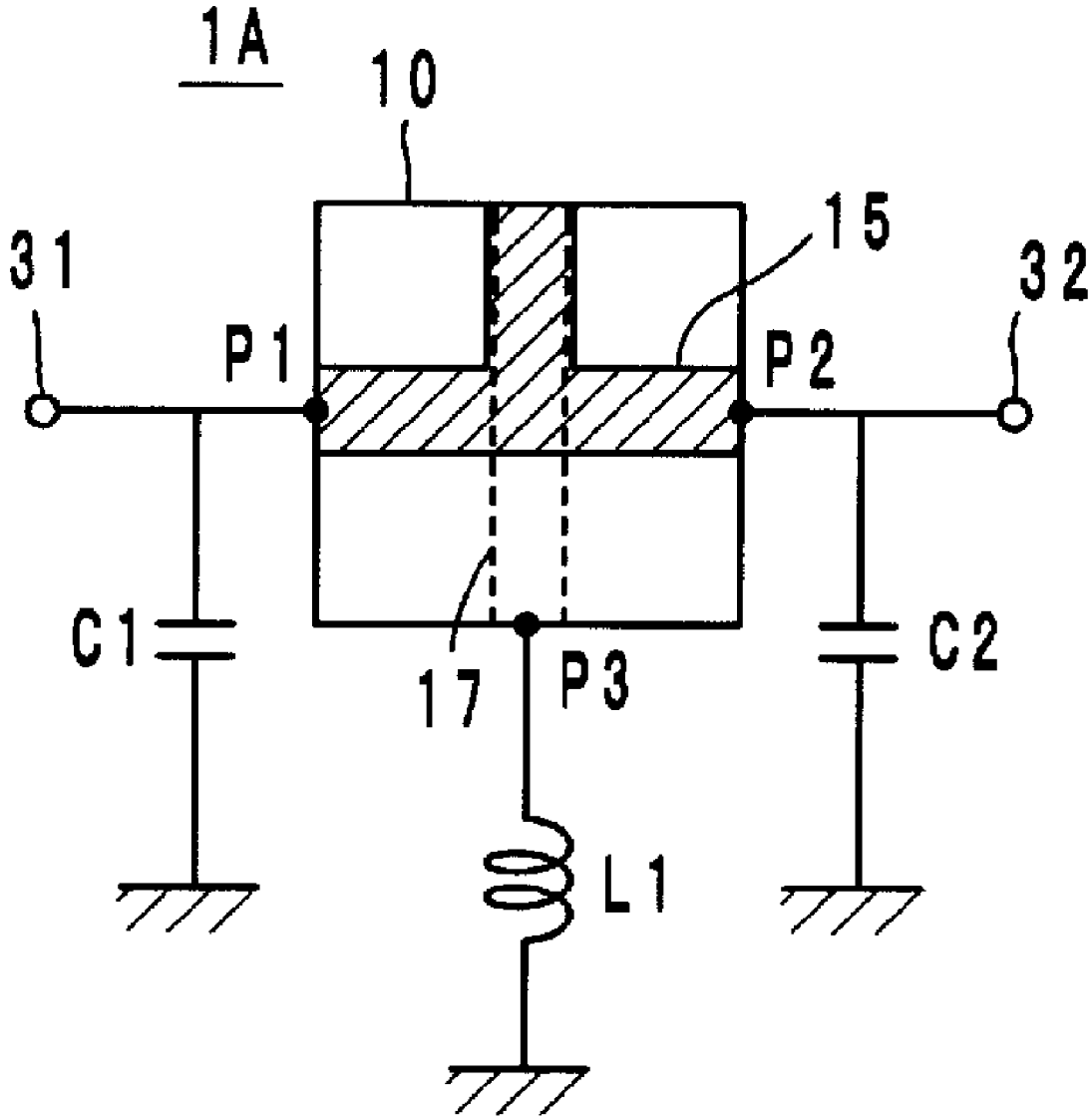
FIG. 4 is an equivalent circuit diagram of the magnetic resonance type isolator according to the first preferred embodiment of the present invention.
Figure 5A:
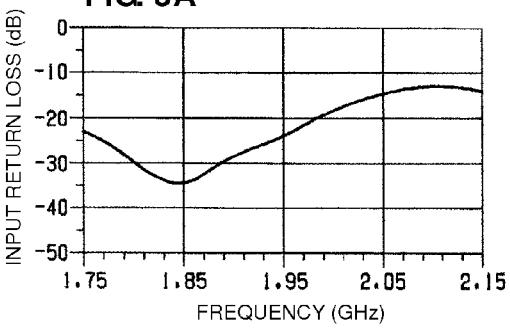
FIGS. 5A-5D are graphs illustrating characteristics of the magnetic resonance type isolator according to the first preferred embodiment of the present invention.
Figure 5B:
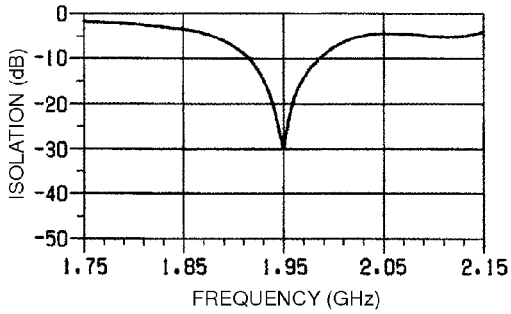
Figure 5C:
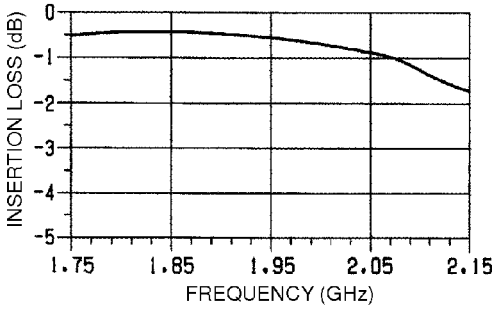
Figure 5D:
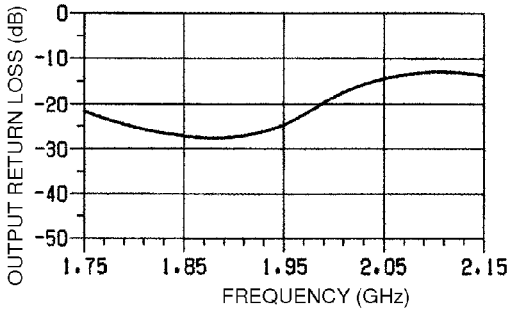

An equivalent circuit is illustrated in FIG. 4. In the magnetic resonance type isolator 1A having the above-described configuration, a wave reflected from the sub-line to which the inductor L1 is connected is modulated such that the phase thereof is shifted by 90° or about 90° at an intersection of the connection conductor 15 with respect to that a wave incident from the first port P1 or the second port P2. In more detail, a wave incident from the first port P1 is transmitted to the second port P2 because a negatively circularly polarized wave is generated at the intersection due to the wave reflected from the sub-line and as a result magnetic resonance is not generated. On the other hand, a wave incident from the second port P2 is absorbed by magnetic resonance due to a positively circularly polarized wave being generated at the intersection as a result of the wave reflected from the sub-line.

The input return loss, isolation, insertion loss and output return loss of the magnetic resonance type isolator 1A of the first preferred embodiment are illustrated in FIGS. 5A, 5B, 5C and 5D, respectively. The inductance of the inductor L1 preferably is about 1.6 nH and the capacitances of the capacitors C1 and C2 preferably are about 1.8 pF, for example. The impedance of the input and output ports preferably is about 35Ω and the electrical characteristics have been normalized preferably using a value of about 35Ω, for example. The insertion loss preferably is about 0.56 dB and the isolation preferably is about 9.9 dB preferably in the range of about 1920 MHz to about 1980 MHz, for example.

In addition, since the main line does not resonate, the main line can be reduced in length to be equal to or less than about ¼ of the wavelength, and in the first preferred embodiment the ferrite 10 preferably has a length and width of about 0.6 mm, a thickness of about 0.15 mm, a line width of about 0.2 mm and a saturation magnetization of about 100 mT, for example. Thus, combined with the fact that the ferrite 10 is much smaller than existing ferrites and the fact that a single inductor L1 is preferably used as a reactance element and the capacitors C1 and C2 are used as matching circuit elements, a magnetic resonance type isolator that is compact and has a low impedance can be obtained.

In particular, in the first preferred embodiment, the reason why the insertion loss characteristics and the isolation characteristics are excellent is that, for example, the opposing conductor 17, which extends in a direction perpendicular or substantially perpendicular to the main line, is arranged between the first and second ports P1 and P2 and as a result a high frequency magnetic field is confined to the ferrite 10 due to the opposing conductor 17 and leakage of the magnetic flux is small. The opposing conductor 17 is not necessarily required.

The magnetic resonance type isolator 1A, for example, can be built into a transmission circuit module of a mobile communication device. The mounting substrate 30 may be a printed wiring board for mounting a power amplifier in a transmission circuit module. In this case, the ferrite 10, which has been provided with the connection conductor 15 and to which the permanent magnet 20 has been adhered, is supplied to the process of assembling the transmission module. This also applies to the other preferred embodiments described hereafter.

Second Preferred Embodiment

A magnetic resonance type isolator 1B according to a second preferred embodiment will be described hereafter with reference to FIGS. 6 and 7B.

Figure 6:
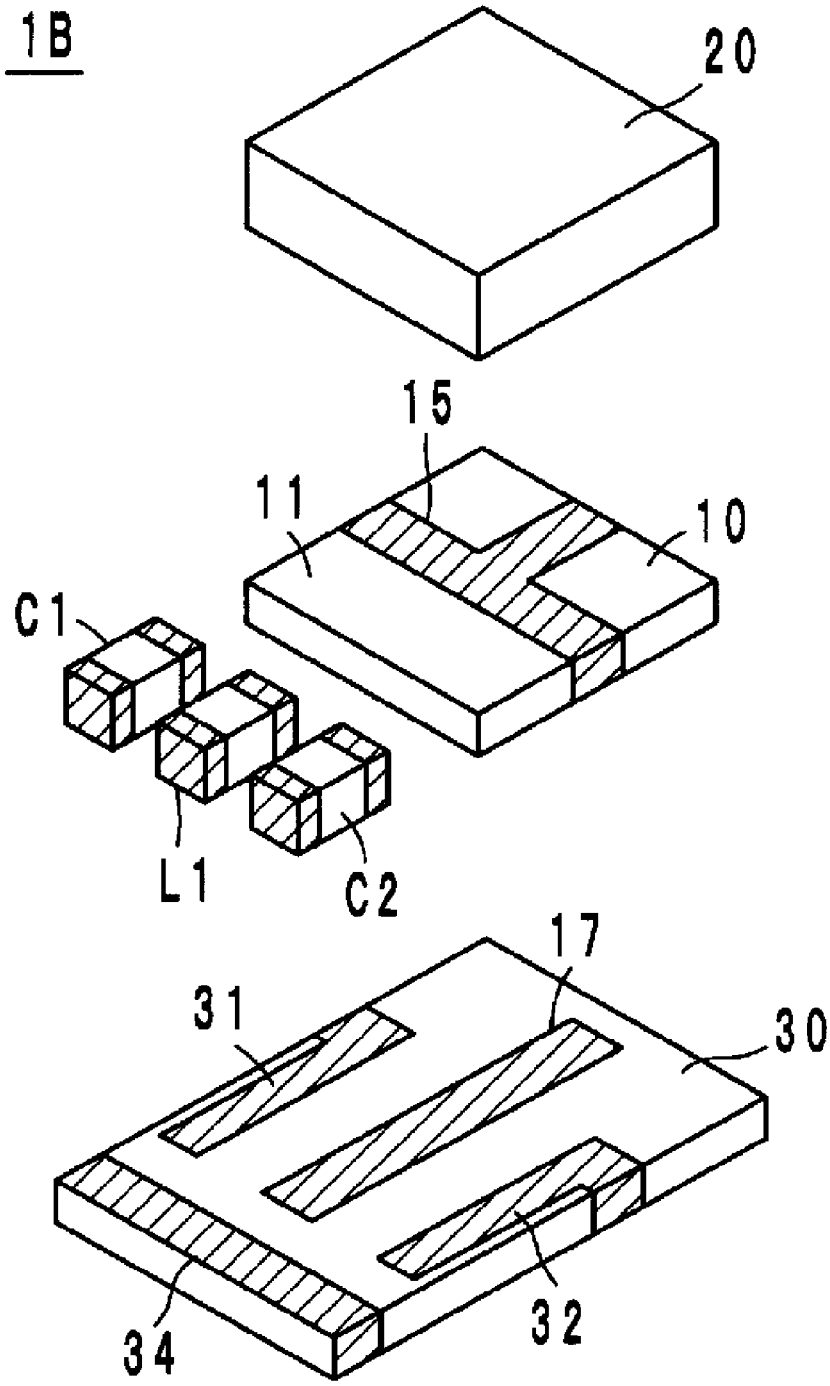
FIG. 6 is an exploded perspective view illustrating the magnetic resonance type isolator according to a second preferred embodiment of the present invention.

The magnetic resonance type isolator 1B according to the second preferred embodiment has the same configuration as that according to the first preferred embodiment except that the opposing conductor 17, which is provided on the second main surface 12 of the ferrite 10 in the first preferred embodiment, is provided on the mounting substrate 30 (refer to FIG. 6). Therefore, the operational advantages are the same as those of the first preferred embodiment.

Figure 7A:
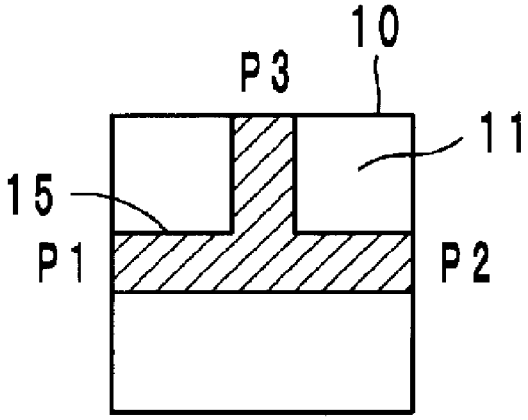
FIG. 7A and FIG. 7B are respectively a top surface view and a bottom surface view of a ferrite of the magnetic resonance type isolator according to the second preferred embodiment of the present invention.
Figure 7B:
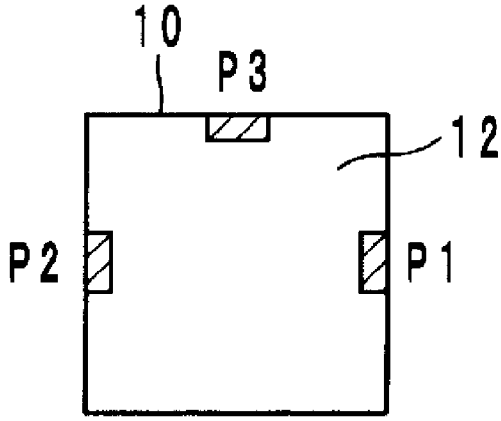
Figure 8:
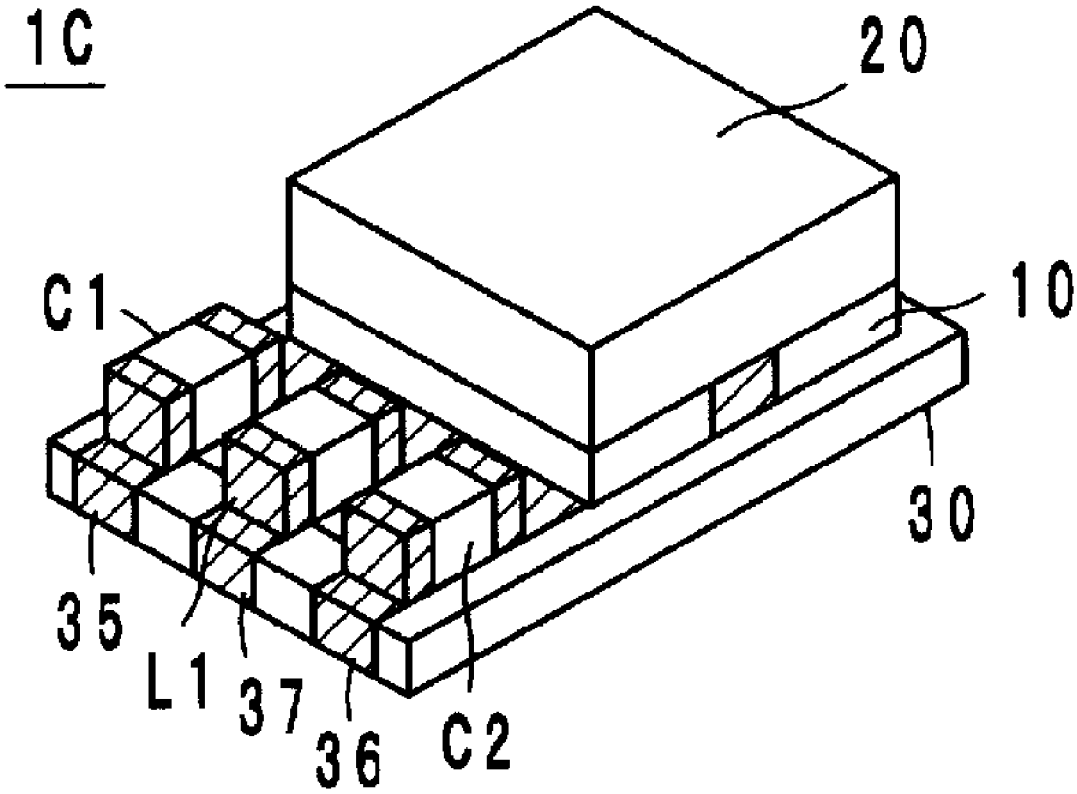
FIG. 8 is a perspective view illustrating a magnetic resonance type isolator according to a third preferred embodiment of the present invention.

In the second preferred embodiment, provided that electrodes on the second main surface 12 side of the ferrite 10 and side surface electrodes can be formed at the same time as illustrated in FIG. 7B, a process for forming a bottom surface electrode pattern can be omitted and the cost can be reduced compared with the first preferred embodiment. Such side surface electrodes can be formed with through holes and electrodes can be formed on the bottom surface by making paste wrap around through a transfer process.

Third Preferred Embodiment

A magnetic resonance type isolator 1C according to a third preferred embodiment will be described hereafter with reference to FIGS. 8 to 11D.

Figure 9:
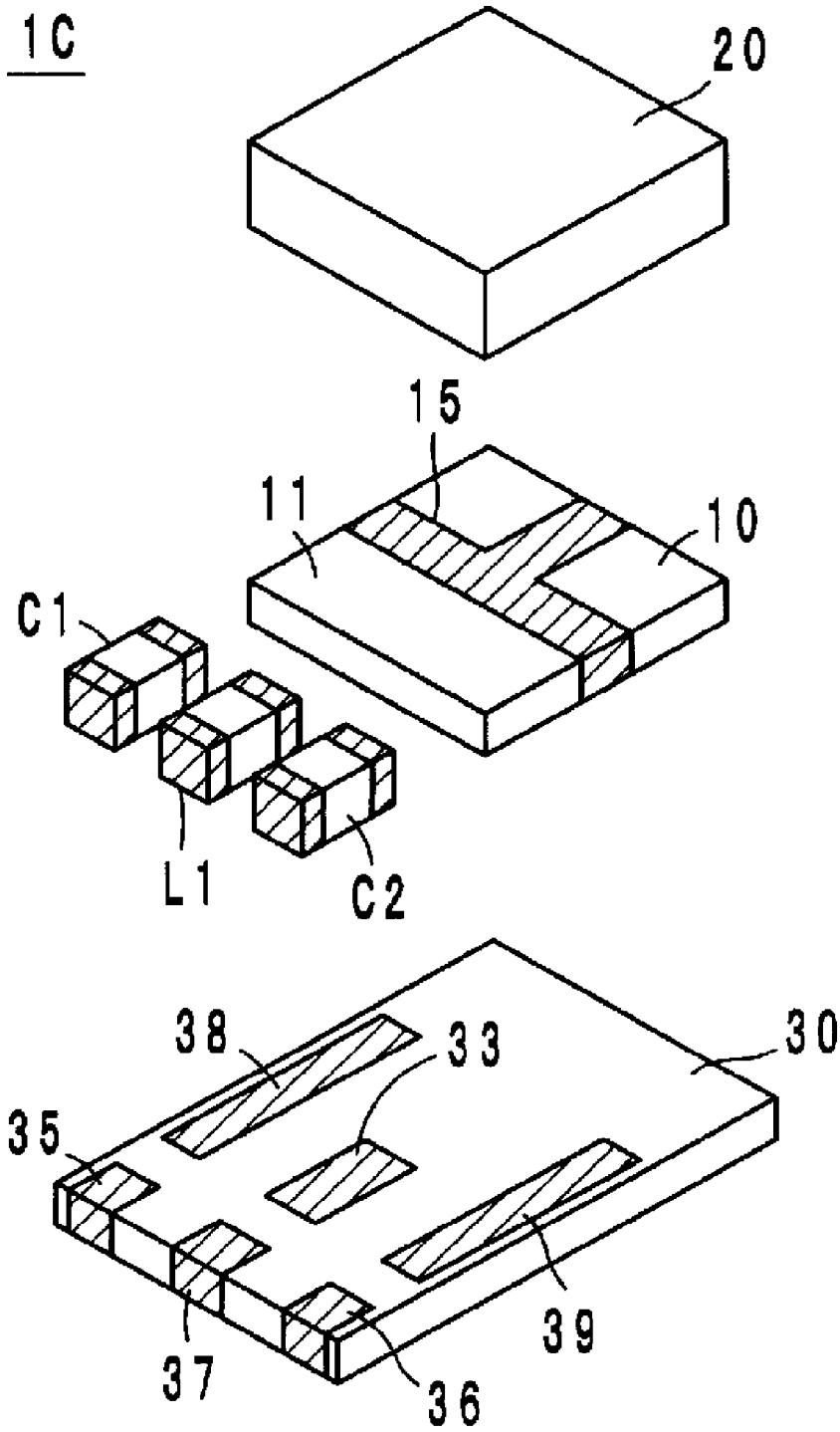
FIG. 9 is an exploded perspective view illustrating the magnetic resonance type isolator according to the third preferred embodiment of the present invention.
Figure 10:
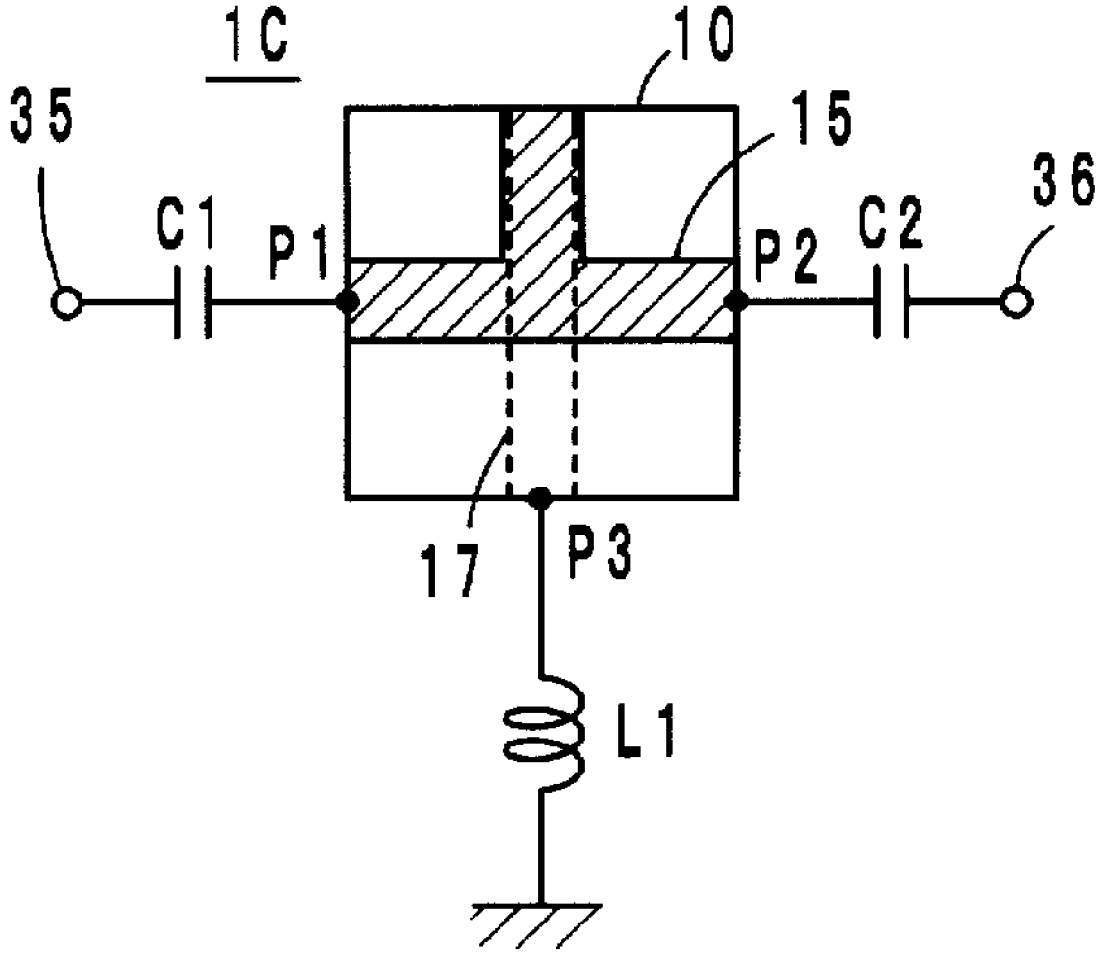
FIG. 10 is an equivalent circuit diagram of the magnetic resonance type isolator according to the third preferred embodiment of the present invention.
Figure 11A:
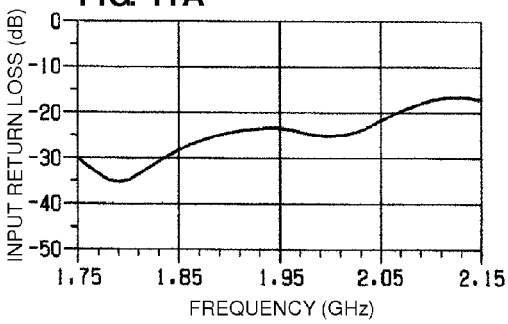
FIGS. 11A-11D are graphs illustrating characteristics of the magnetic resonance type isolator according to the third preferred embodiment of the present invention.
Figure 11B:
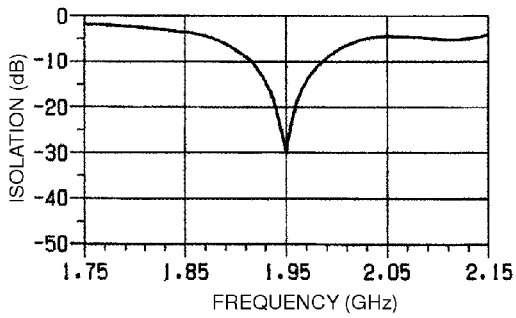
Figure 11C:
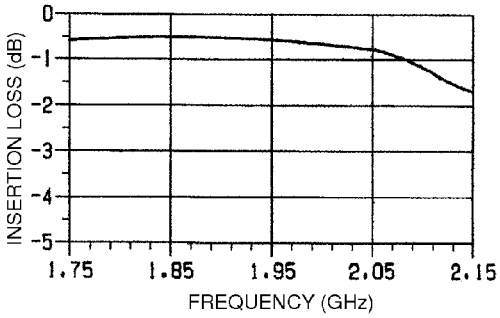
Figure 11D:
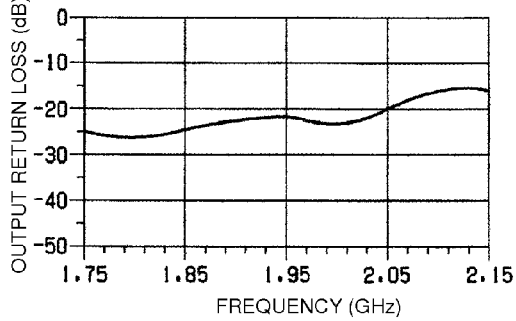
Figure 12:
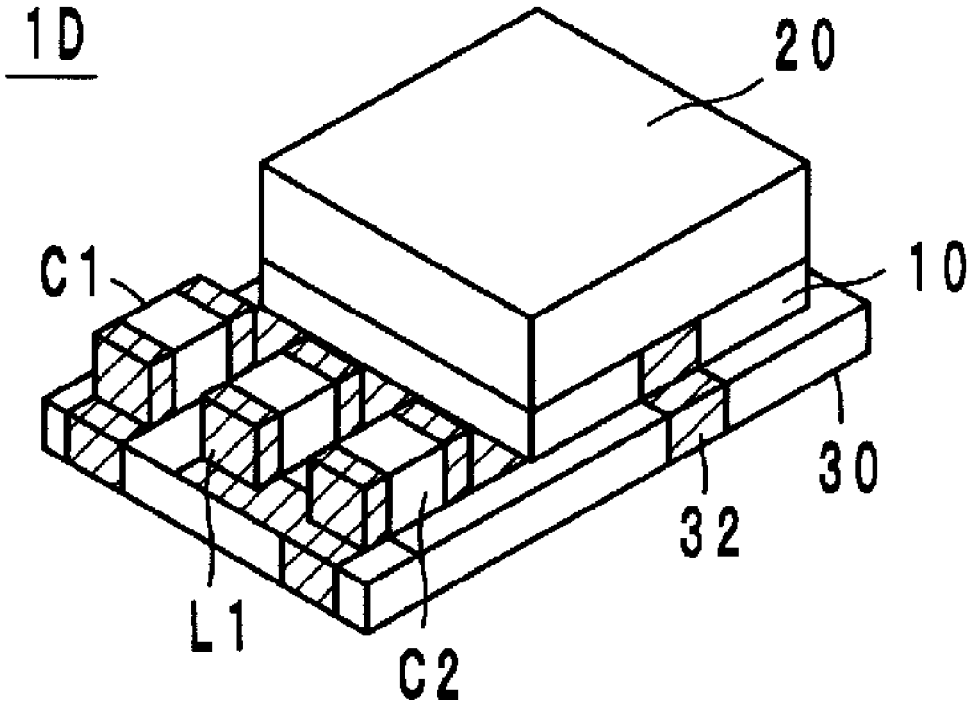
FIG. 12 is a perspective view illustrating a magnetic resonance type isolator according to a fourth preferred embodiment of the present invention.

In the magnetic resonance type isolator 1C according to the third preferred embodiment, the capacitor C1 is connected in series between the first port P1 and an input terminal electrode 35, and the capacitor C2 is connected in series between the second port P2 and an output terminal electrode 36, as illustrated in the equivalent circuit of FIG. 10. As illustrated in FIG. 9, the input terminal electrode 35, the output terminal electrode 36, a ground terminal electrode 37 and relay terminal electrodes 33, 38 and 39 are provided on the mounting substrate 30. The rest of the configuration is preferably the same as those of the first preferred embodiment.

One end of the main line (first port P1) is connected to the input terminal electrode 35 though the relay terminal electrode 38 and the capacitor C1 and the other end of the main line (second port P2) is connected to the output terminal electrode 36 through the relay terminal electrode 39 and the capacitor C2. An end portion of the sub-line (third port P3) is connected to the ground terminal electrode 37 through the relay terminal electrode 33 and the inductor L1.

The operational advantages of the third preferred embodiment are basically the same as those of the first preferred embodiment. The input return loss, isolation, insertion loss and output return loss of the magnetic resonance type isolator 1C of the third preferred embodiment are illustrated in FIGS. 11A, 11B, 11C and 11D, respectively. The inductance of the inductor L1 preferably is about 1.6 nH and the capacitances of the capacitors C1 and C2 preferably are about 4.3 pF, for example. The impedance of the input and output terminals preferably is about 25Ω and the electrical characteristics have been normalized preferably using a value of about 25Ω, for example. The insertion loss preferably is about 0.54 dB and the isolation is preferably about 9.9 dB preferably in the range of about 1920 MHz to about 1980 MHz. The size and the like of the ferrite 10 are preferably the same as those of the ferrite 10 of the first preferred embodiment.

Fourth Preferred Embodiment

A magnetic resonance type isolator 1D according to a fourth preferred embodiment will be described hereafter with reference to FIGS. 12 to 15D.

Figure 13:
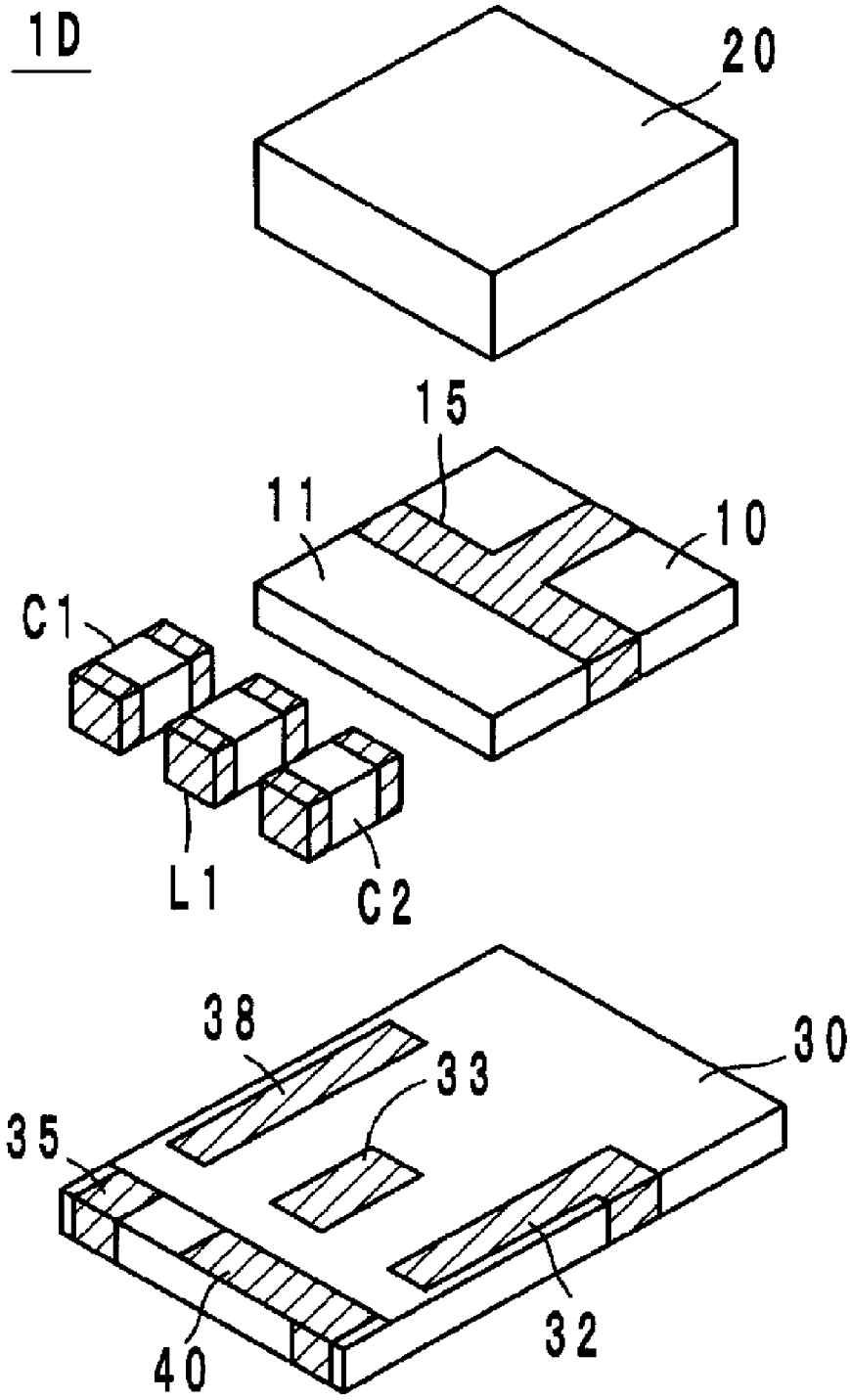
FIG. 13 is an exploded perspective view illustrating the magnetic resonance type isolator according to the fourth preferred embodiment of the present invention.
Figure 14:
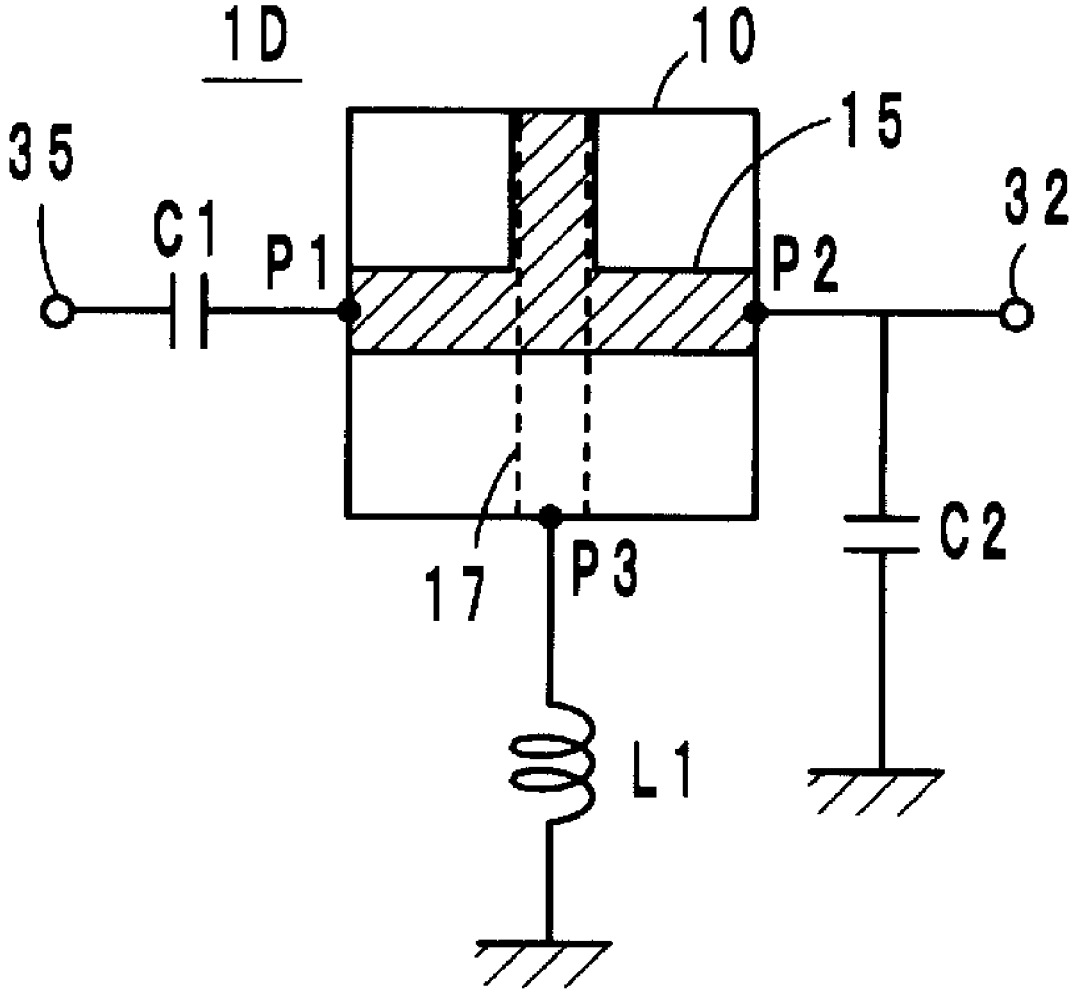
FIG. 14 is an equivalent circuit diagram of the magnetic resonance type isolator according to the fourth preferred embodiment of the present invention.
Figure 15A:
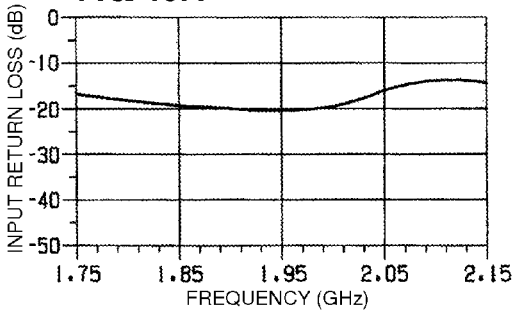
FIGS. 15A-15D are graphs illustrating characteristics of the magnetic resonance type isolator according to the fourth preferred embodiment of the present invention.
Figure 15B:
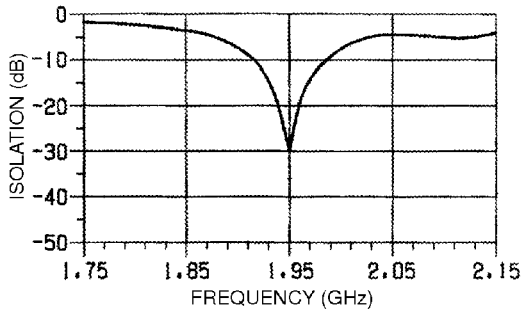
Figure 15C:
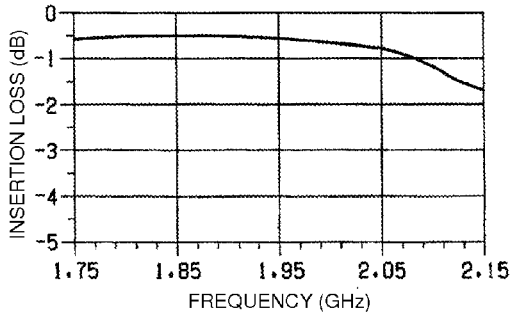
Figure 15D:
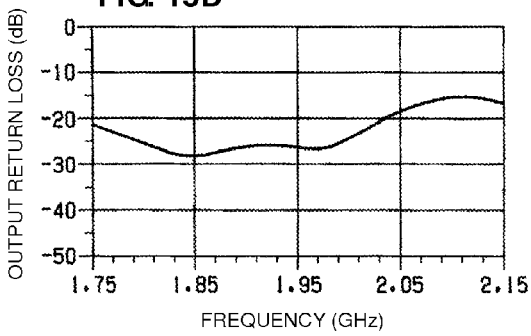

In the magnetic resonance type isolator 1D according to the fourth preferred embodiment, the capacitor C1 is connected in series between the first port P1 and the input terminal electrode 35 and the capacitor C2, which is connected to the ground, is connected between the second port P2 and the output terminal electrode 32, as illustrated in the equivalent circuit of FIG. 14. As illustrated in FIG. 13, the input terminal electrode 35, the output terminal electrode 32, a ground terminal electrode 40, and the relay terminal electrodes 33 and 38 are provided on the mounting substrate 30. The rest of the configuration is the same as those of the first preferred embodiment.

One end of the main line (first port P1) is connected to the input terminal electrode 35 though the relay terminal electrode 38 and the capacitor C1 and the other end of the main line (second port P2) is connected to the output terminal electrode 32 and to the ground terminal electrode 40 through the capacitor C2. An end portion of the sub-line (third port P3) is connected to the ground terminal electrode 40 through the relay terminal electrode 33 and the inductor L1.

The operational advantages of the fourth preferred embodiment are basically the same as those of the first preferred embodiment. The input return loss, isolation, insertion loss and output return loss of the magnetic resonance type isolator 1D of the fourth preferred embodiment are illustrated in FIGS. 15A, 15B, 15C and 15D, respectively. The inductance of the inductor L1 preferably is about 1.6 nH, the capacitance of the capacitor C1 preferably is about 4.0 pF and the capacitance of the capacitor C2 preferably is about 1.7 pF, for example. The impedance of the input port preferably is about 25Ω, the impedance of the output port preferably is about 35Ω and the electrical characteristics have been normalized preferably using an input of about 25Ω and an output of about 35Ω, for example. The insertion loss preferably is about 0.55 dB and the isolation preferably is about 9.9 dB preferably in the range of about 1920 MHz to about 1980 MHz, for example. The size and the like of the ferrite 10 are preferably the same as those of the ferrite 10 in the first preferred embodiment.

In particular, in the fourth preferred embodiment, the impedances of the input port and the output port are different and there is an impedance conversion function. In a cellular phone, in the case where an isolator of the related art is connected downstream of a power amplifier, typically, the power amplifier has a low impedance (on the order of about 5Ω, for example) and therefore an impedance conversion circuit has been added to increase the impedance. With the magnetic resonance type isolator 1D, the impedance of the input is lowered and therefore the impedance conversion circuit can be partially omitted and reductions in size and cost can be realized.

Fifth Preferred Embodiment

A magnetic resonance type isolator 1E according to a fifth preferred embodiment will be described hereafter with reference to FIGS. 16 to 18D.

Figure 16:
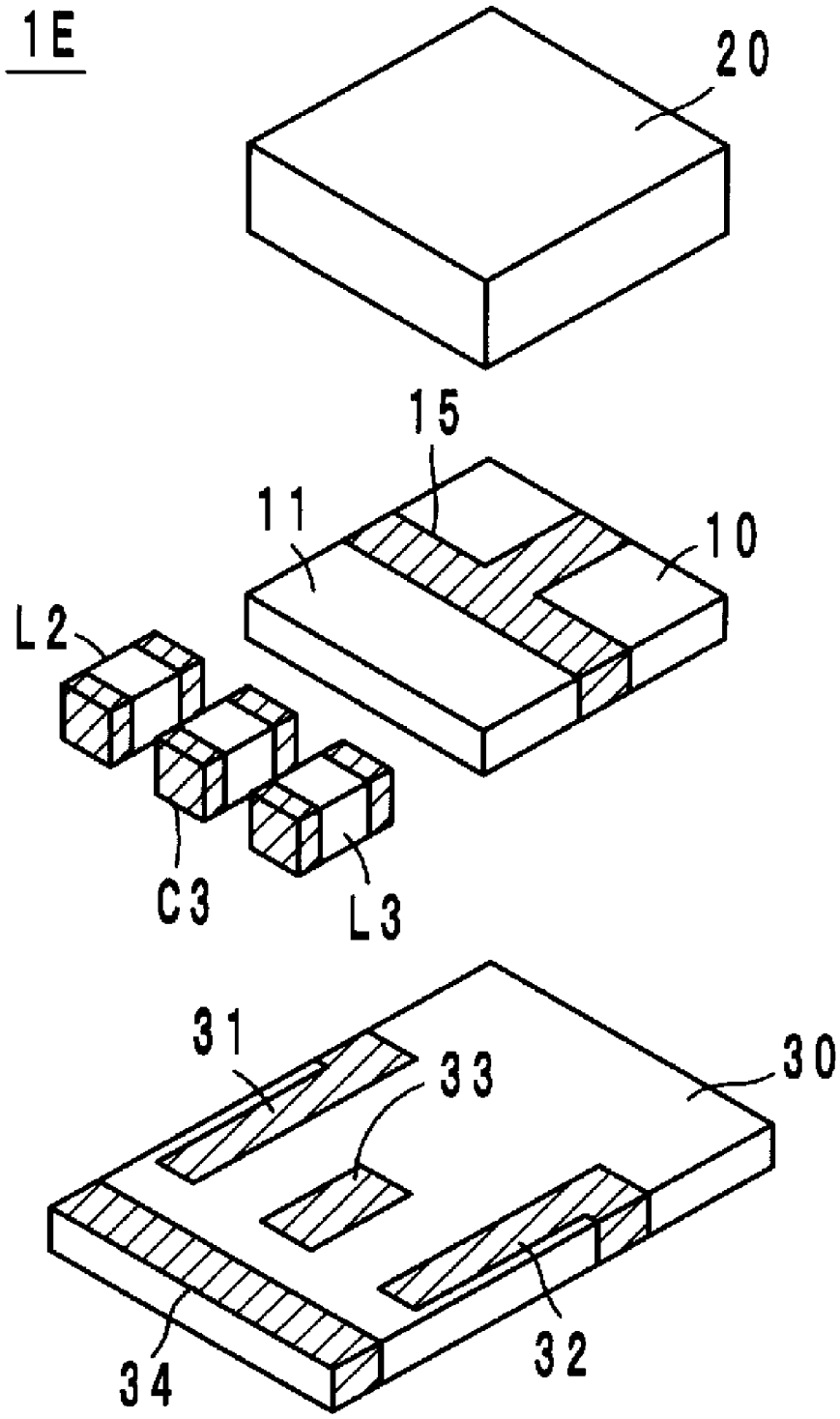
FIG. 16 is an exploded perspective view illustrating a magnetic resonance type isolator according to a fifth preferred embodiment of the present invention.
Figure 17:
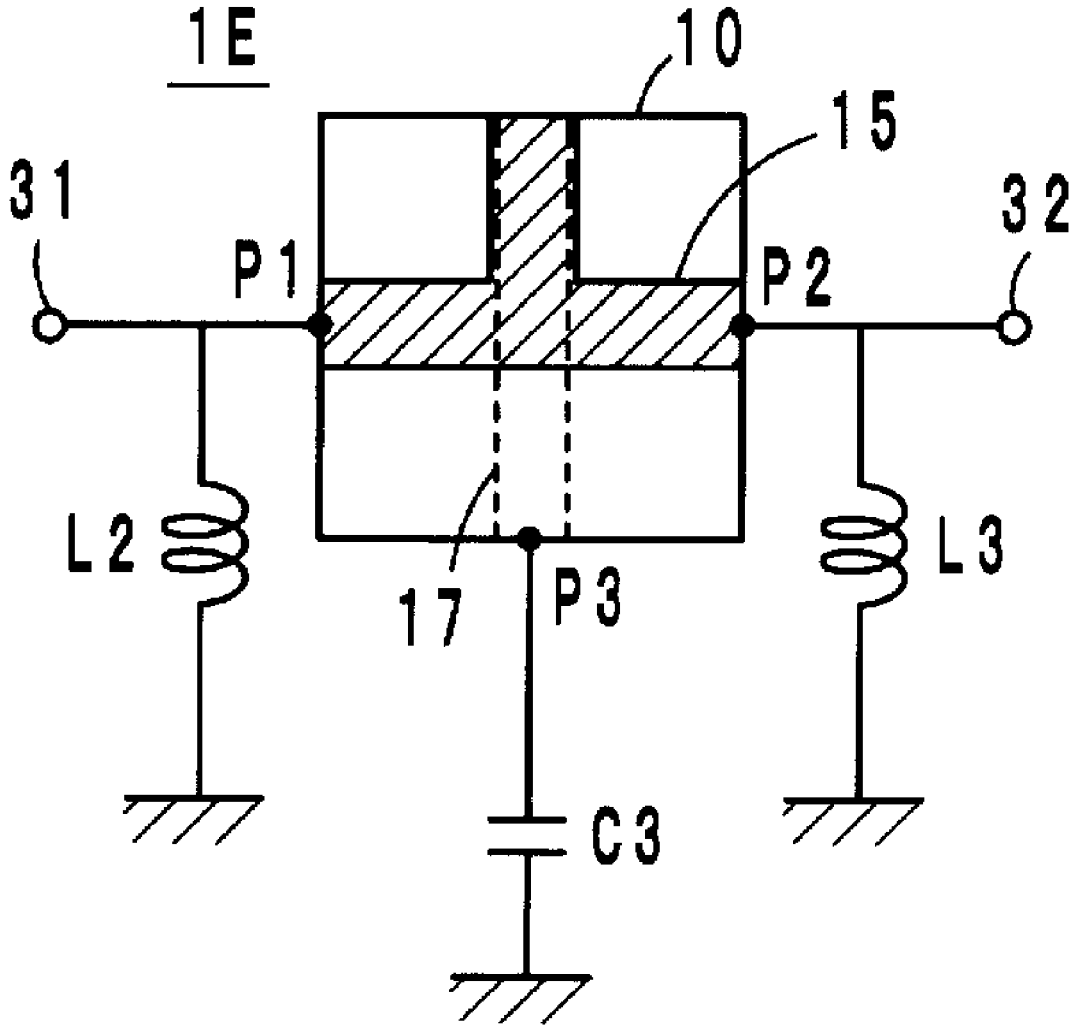
FIG. 17 is an equivalent circuit diagram of the magnetic resonance type isolator according to the fifth preferred embodiment of the present invention.
Figure 18A:
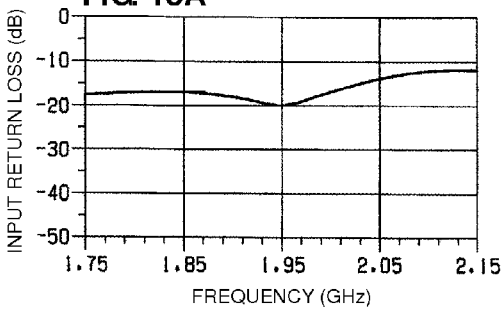
FIGS. 18A-18D are graphs illustrating characteristics of the magnetic resonance type isolator according to the fifth preferred embodiment of the present invention.
Figure 18B:
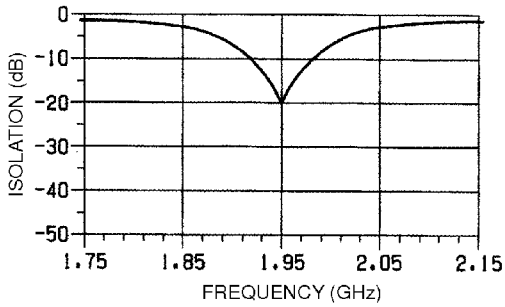
Figure 18C:
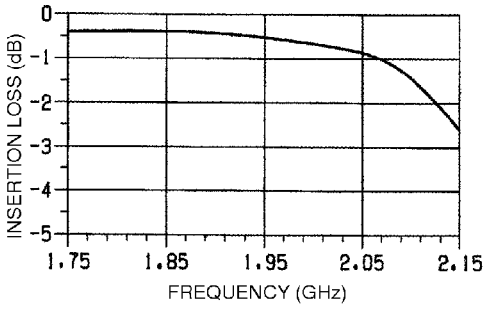
Figure 18D:
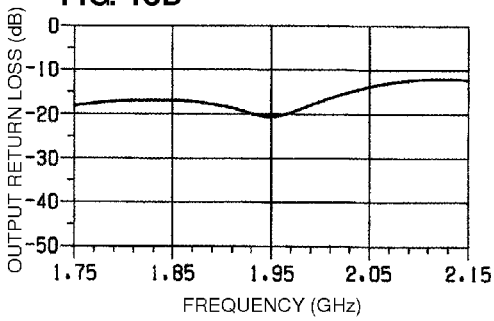

In the magnetic resonance type isolator 1E according to the fifth preferred embodiment, as illustrated in the equivalent circuit of FIG. 17, a capacitor C3 is preferably used as a reactance element, and inductors L2 and L3, which are connected to the ground, are connected between the first port P1 and the input terminal electrode 31 and between the second port P2 and the output terminal electrode 32, respectively. As illustrated in FIG. 16, the input terminal electrode 31, the output terminal electrode 32, the relay terminal electrode 33 and the ground terminal electrode 34 are provided on the mounting substrate 30.

One end of the main line (first port P1) is connected to the input terminal electrode 31 and is connected to the ground terminal electrode 34 through the inductor L2. The other end of the main line (second port P2) is connected to the output terminal electrode 32 and is connected to the ground terminal electrode 34 through the inductor L3. An end portion of the sub-line (third port P3) is connected to the ground terminal electrode 34 through the relay terminal electrode 33 and the capacitor C3.

The operational advantages of the fifth preferred embodiment are basically the same as those of the first preferred embodiment. The input return loss, isolation, insertion loss and output return loss of the magnetic resonance type isolator 1E of the fifth preferred embodiment are illustrated in FIGS. 18A, 18B, 18C and 18D, respectively. The capacitance of the capacitor C3 preferably is about 3.1 pF and the inductances of the inductors L2 and L3 preferably are about 9.1 nH, for example. The impedance of the input and output ports preferably is about 25Ω and the electrical characteristics have been normalized preferably using a value of about 25Ω, for example. The insertion loss preferably is about 0.53 dB and the isolation preferably is about 9.8 dB preferably in the range of about 1920 MHz to about 1980 MHz, for example. The size and the like of the ferrite 10 are preferably the same as those of the ferrite 10 in the first preferred embodiment.

Sixth Preferred Embodiment

A magnetic resonance type isolator 1F according to a sixth preferred embodiment will be described hereafter with reference to FIGS. 19 to 21D.

Figure 19:
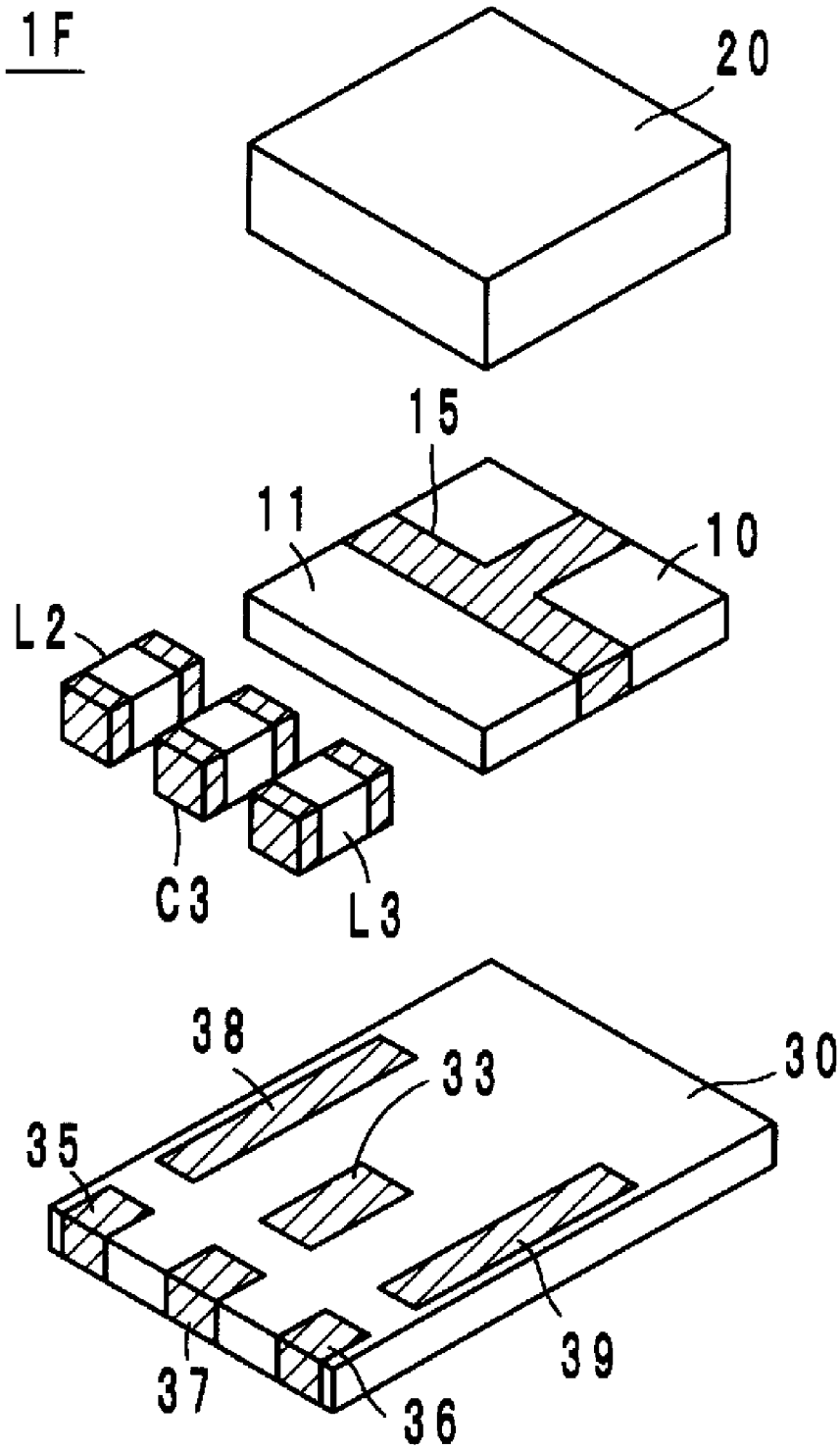
FIG. 19 is an exploded perspective view illustrating a magnetic resonance type isolator according to a sixth preferred embodiment of the present invention.
Figure 20:
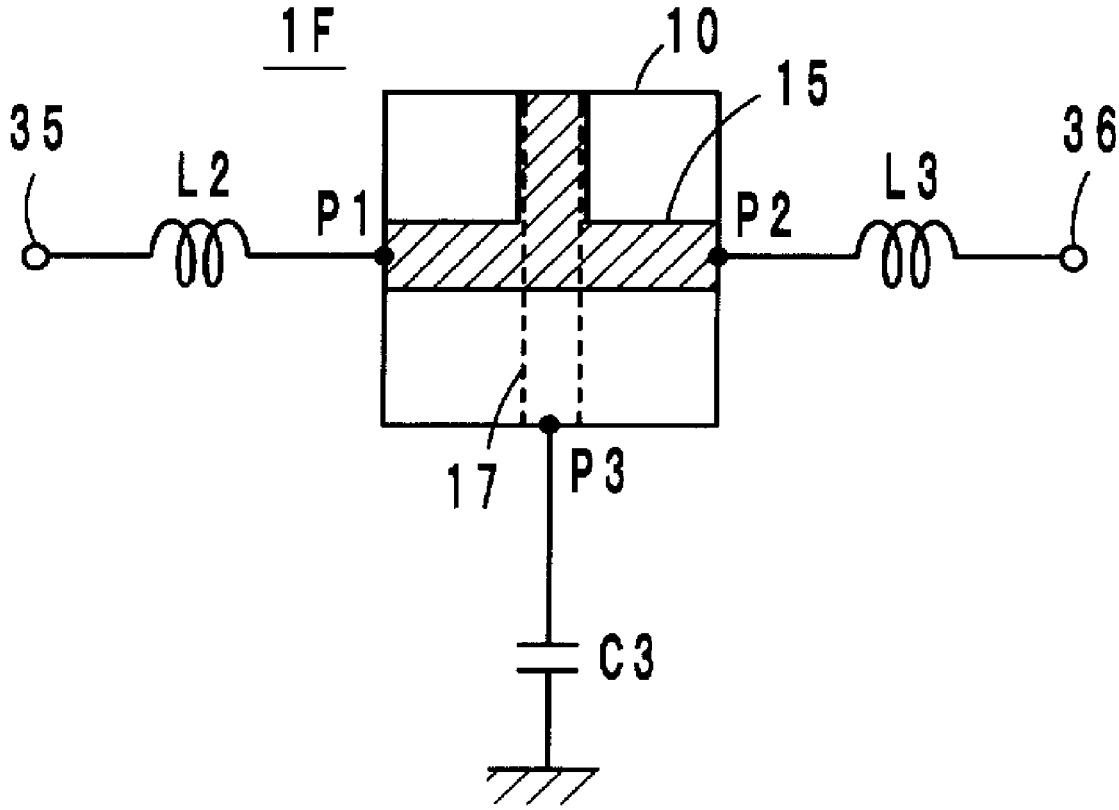
FIG. 20 is an equivalent circuit diagram of the magnetic resonance type isolator according to the sixth preferred embodiment of the present invention.
Figure 21A:
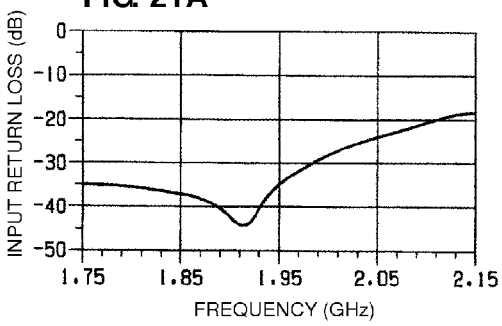
FIGS. 21A-21D are graphs illustrating characteristics of the magnetic resonance type isolator according to the sixth preferred embodiment of the present invention.
Figure 21B:
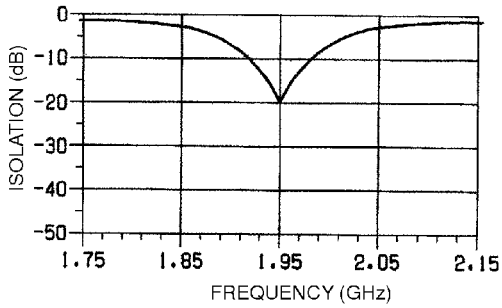
Figure 21C:
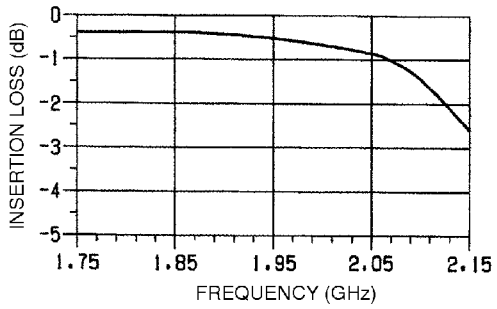
Figure 21D:
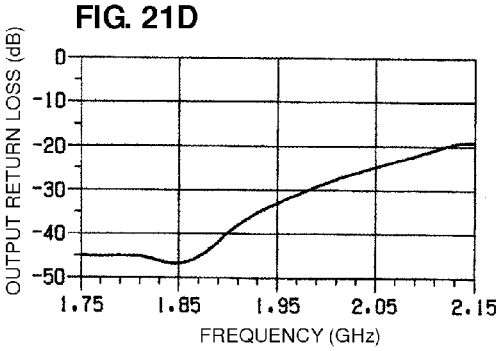

In the magnetic resonance type isolator 1F according to the sixth preferred embodiment, as illustrated in the equivalent circuit of FIG. 20, the capacitor C3 is preferably used as a reactance element, and the inductor L2 is connected in series between the first port P1 and the input terminal electrode 35 and the inductor L3 is connected in series between the second port P2 and the output terminal electrode 36, respectively. As illustrated in FIG. 19, the input terminal electrode 35, the output terminal electrode 36, the ground terminal electrode 37 and relay terminal electrodes 33, 38 and 39 are provided on the mounting substrate 30. The rest of the configuration is the same as those of the first preferred embodiment.

One end of the main line (first port P1) is connected to the input terminal electrode 35 though the relay terminal electrode 38 and the inductor L2 and the other end of the main line (second port P2) is connected to the output terminal electrode 36 through the relay terminal electrode 39 and the inductor L3. An end portion of the sub-line (third port P3) is connected to the ground terminal electrode 37 through the relay terminal electrode 33 and the capacitor C3.

The operational advantages of the sixth preferred embodiment are basically the same as those of the first preferred embodiment. The input return loss, isolation, insertion loss and output return loss of the magnetic resonance type isolator 1F of the sixth preferred embodiment are illustrated in FIGS. 21A, 21B, 21C and 21D, respectively. The capacitance of the capacitor C3 preferably is about 3.1 pF and the inductances of the inductors L2 and L3 preferably are about 0.6 nH, for example. The impedance of the input and output ports preferably is about 20Ω and the electrical characteristics have been normalized preferably using a value of about 20Ω, for example. The insertion loss preferably is about 0.46 dB and the isolation preferably is about 9.7 dB preferably in the range of about 1920 MHz to about 1980 MHz, for example. The size and the like of the ferrite 10 are preferably the same as those of the ferrite 10 in the first preferred embodiment.

Seventh Preferred Embodiment

A magnetic resonance type isolator 1G according to a seventh preferred embodiment will be described hereafter with reference to FIGS. 22 to 24D.

Figure 22:
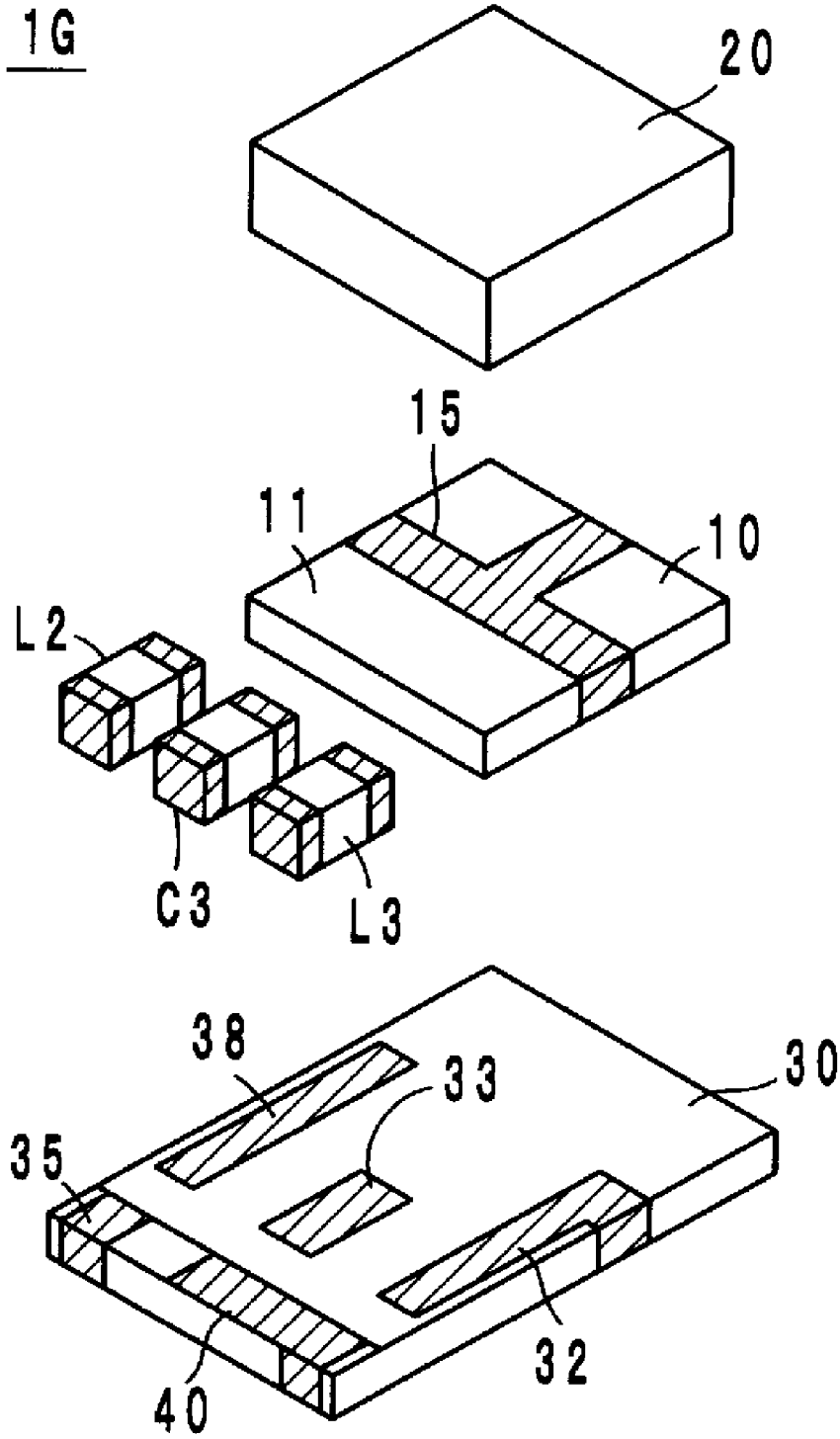
FIG. 22 is an exploded perspective view illustrating a magnetic resonance type isolator according to a seventh preferred embodiment of the present invention.
Figure 23:
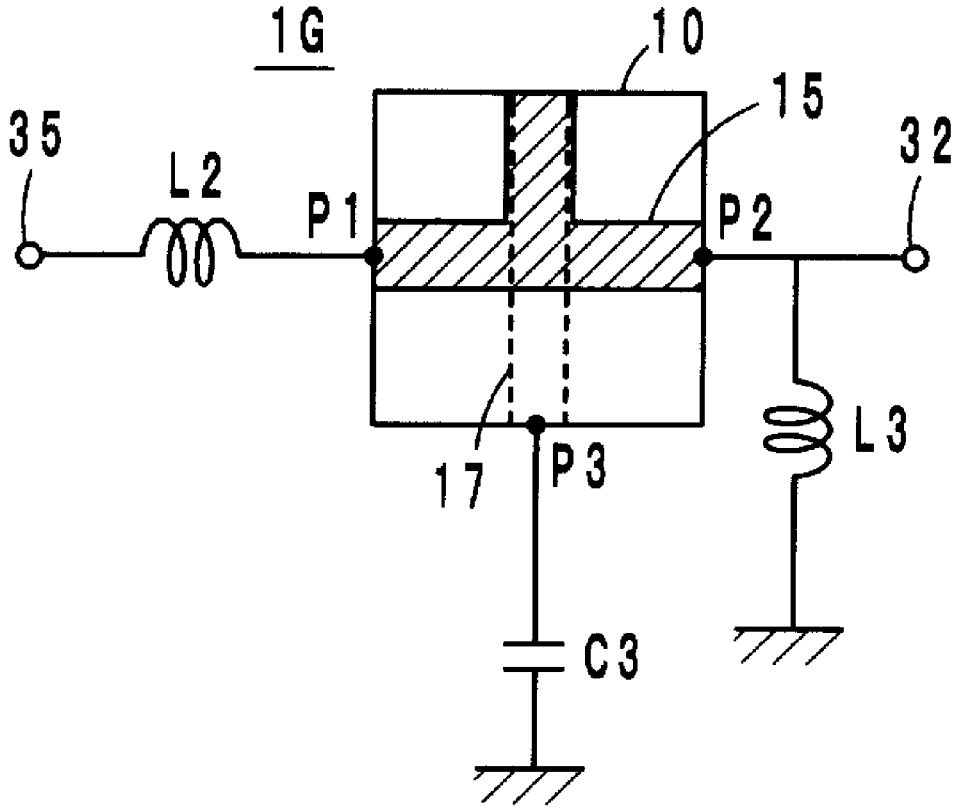
FIG. 23 is an equivalent circuit diagram of the magnetic resonance type isolator according to the seventh preferred embodiment of the present invention.
Figure 24A:
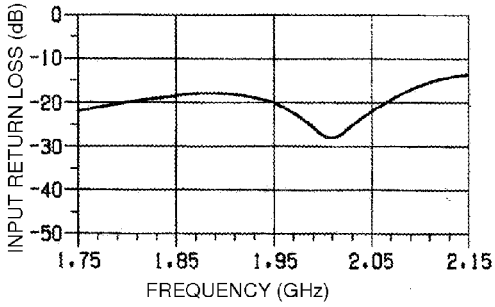
FIGS. 24A-24D are graphs illustrating characteristics of the magnetic resonance type isolator according to the seventh preferred embodiment of the present invention.
Figure 24B:
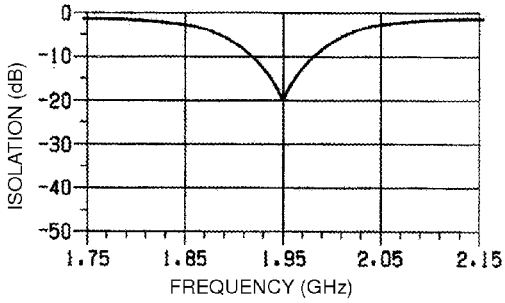
Figure 24C:
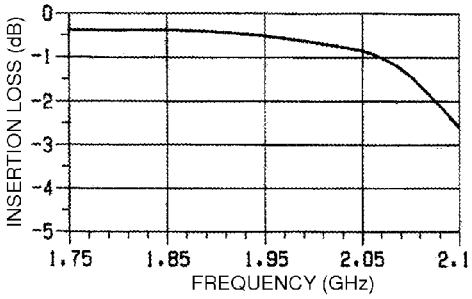
Figure 24D:
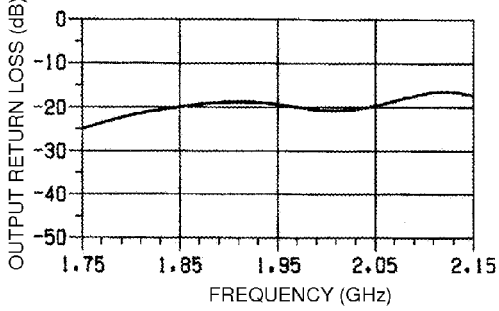
Figure 25:
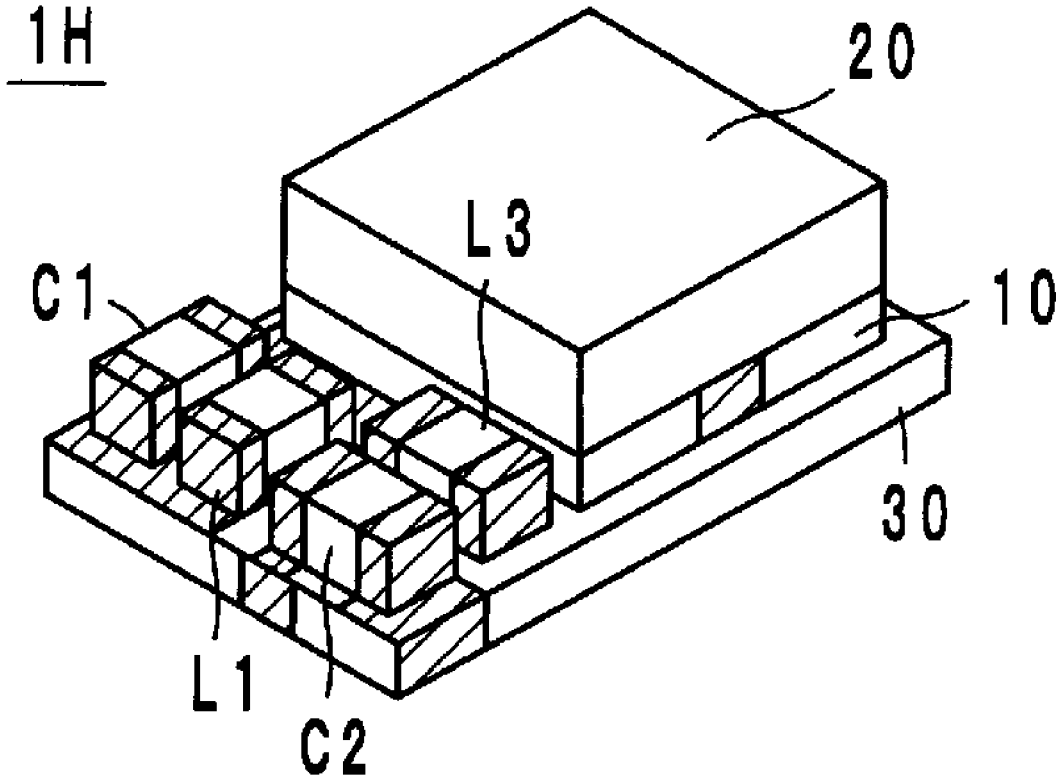
FIG. 25 is a perspective view illustrating a magnetic resonance type isolator according to an eighth preferred embodiment of the present invention.

In the magnetic resonance type isolator 1G according to the seventh preferred embodiment, as illustrated in the equivalent circuit of FIG. 23, the capacitor C3 is preferably used as a reactance element, and the inductor L2 is connected in series between the first port P1 and the input terminal electrode 35, and the inductor L3, which is connected to the ground, is connected between the second port P2 and the output terminal electrode 32. As illustrated in FIG. 22, the input terminal electrode 35, the output terminal electrode 32, the ground terminal electrode 40, and the relay terminal electrodes 33 and 38 are provided on the mounting substrate 30. The rest of the configuration is preferably the same as that of the first preferred embodiment.

One end of the main line (first port P1) is connected to the input terminal electrode 35 though the relay terminal electrode 38 and the inductor L2 and the other end of the main line (second port P2) is connected to the output terminal electrode 32 and to the ground terminal electrode 40 through the inductor L3. An end portion of the sub-line (third port P3) is connected to the ground terminal electrode 40 through the relay terminal electrode 33 and the capacitor C3.

The operational advantages of the seventh preferred embodiment are basically the same as those of the first preferred embodiment. The input return loss, isolation, insertion loss and output return loss of the magnetic resonance type isolator 1G of the seventh preferred embodiment are illustrated in FIGS. 24A, 24B, 24C and 24D, respectively. The capacitance of the capacitor C3 preferably is about 3.1 pF, the inductance of the inductor L2 preferably is about 0.9 nH and the inductance of the inductor L3 preferably is about 10 nH, for example. The impedance of the input port preferably is about 20Ω, the impedance of the output port preferably is about 25Ω and the electrical characteristics have been normalized preferably using an input of about 20Ω and an output of about 25Ω, for example. The insertion loss preferably is about 0.53 dB and the isolation preferably is about 9.9 dB in the range of about 1920 MHz to about 1980 MHz, for example. The size and the like of the ferrite 10 are preferably the same as those of the ferrite 10 in the first preferred embodiment.

In particular, in the seventh preferred embodiment, the impedances of the input port and the output port are different and there is an impedance conversion function. The advantage due to this point is the same as that of the fourth preferred embodiment.

Eighth Preferred Embodiment

A magnetic resonance type isolator 1H according to an eighth preferred embodiment will be described hereafter with reference to FIGS. 25 to 28D.

Figure 26:
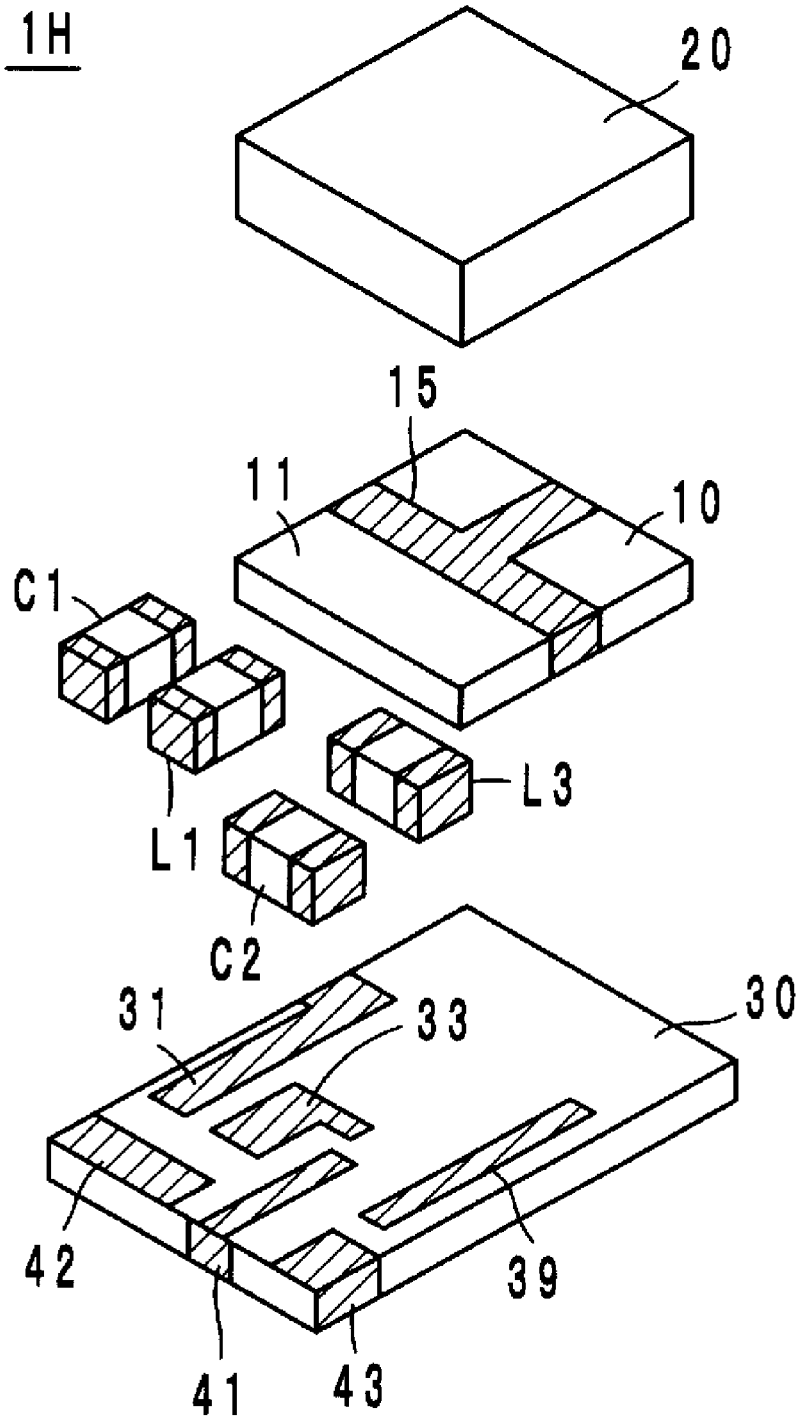
FIG. 26 is an exploded perspective view illustrating the magnetic resonance type isolator according to the eighth preferred embodiment of the present invention.
Figure 27:
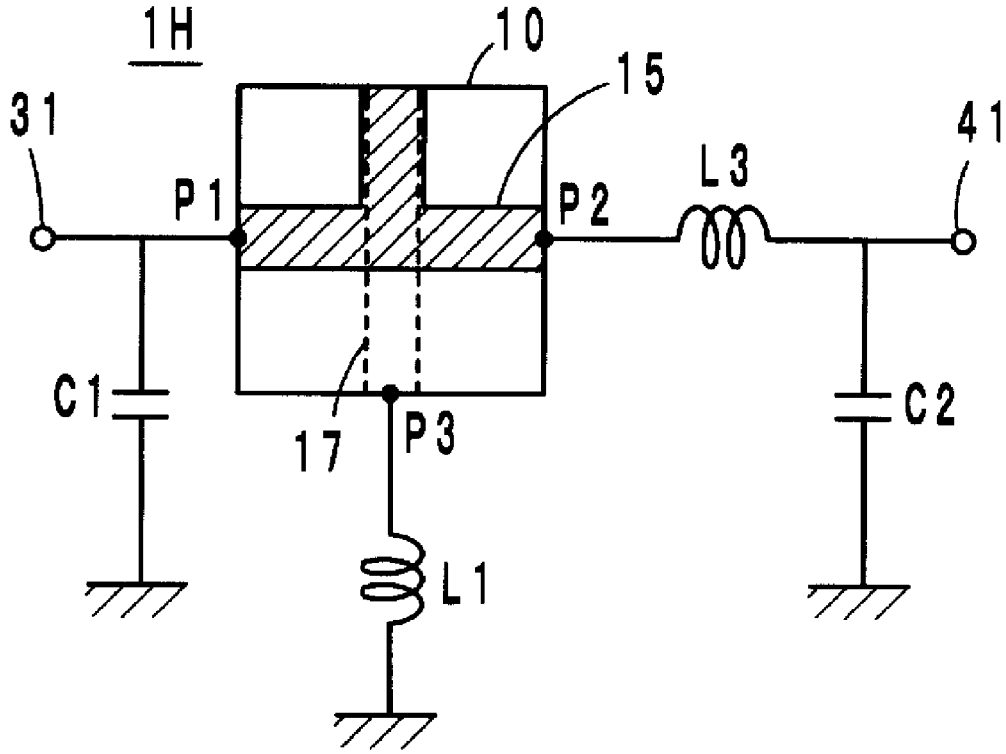
FIG. 27 is an equivalent circuit diagram of the magnetic resonance type isolator according to the eighth preferred embodiment of the present invention.
Figure 28A:
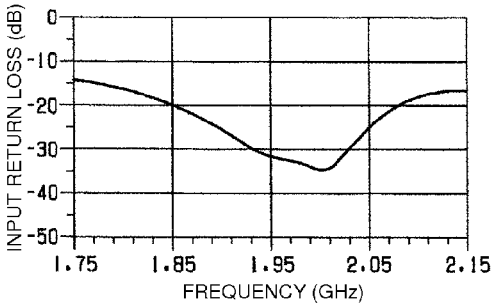
FIGS. 28A-28D are graphs illustrating characteristics of the magnetic resonance type isolator according to the eighth preferred embodiment of the present invention.
Figure 28B:
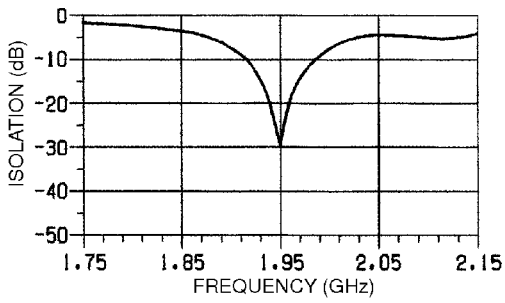
Figure 28C:
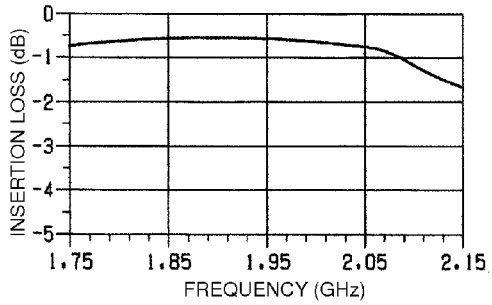
Figure 28D:
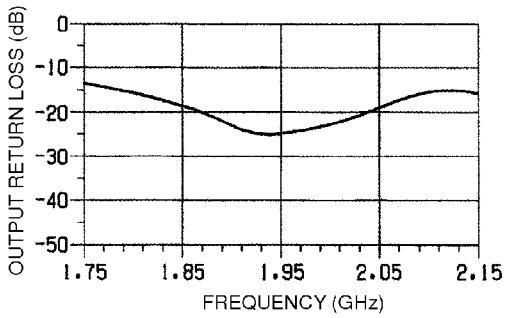

In the magnetic resonance type isolator 1H according to the eighth preferred embodiment, in contrast to the magnetic isolator type isolator 1A according to the first preferred embodiment (refer to FIG. 4), as illustrated in FIG. 27, the inductor L3 is connected in series between the second port P2 and an output terminal electrode 41 and a matching circuit on the output side includes the inductor L3 and the capacitor C2. As illustrated in FIG. 26, the input terminal electrode 31, the output terminal electrode 41, ground terminal electrodes 42 and 43, and the relay terminal electrodes 33 and 39 are provided on the mounting substrate 30. The rest of the configuration is the same as that of the first preferred embodiment.

One end of the main line (first port P1) is connected to the input terminal electrode 31 and is connected to the ground terminal electrode 42 through the capacitor C1. The other end of the main line (second port P2) is connected to the output terminal electrode 41 through the relay terminal electrode 39 and the inductor L3 and the output terminal is connected to the ground terminal electrode 43 through the capacitor C2. An end portion of the sub-line (third port P3) is connected to the ground terminal electrode 42 through the relay terminal electrode 33 and the inductor L1.

The operational advantages of the eighth preferred embodiment are basically the same as those of the first preferred embodiment. The input return loss, isolation, insertion loss and output return loss of the magnetic resonance type isolator 1H of the eighth preferred embodiment are illustrated in FIGS. 28A, 28B, 28C and 28D, respectively. The inductance of the inductor L1 preferably is about 1.7 nH, the capacitance of the capacitor C1 preferably is about 1.4 pF, the capacitance of the capacitor C2 preferably is about 1.6 pF and the inductance of the inductor L3 preferably is about 0.6 nH, for example. The impedance of the input port preferably is about 35Ω, the impedance of the output port preferably is about 50Ω and the electrical characteristics have been normalized preferably using an input of about 35Ω and an output of about 50Ω, for example. The insertion loss preferably is about 0.55 dB and the isolation preferably is about 9.9 dB preferably in the range of about 1920 to 1980 MHz, for example. The size and the like of the ferrite 10 are preferably the same as those of the ferrite 10 in the first preferred embodiment.

In particular, in the eighth preferred embodiment, the impedances of the input port and the output port are different and there is an impedance conversion function. The advantage due to this point is the same as that of the fourth preferred embodiment. Furthermore, since the impedance of the output port is preferably about 50Ω, there is no need for an impedance conversion circuit on the output side.

Ninth Preferred Embodiment

A magnetic resonance type isolator 1I according to a ninth preferred embodiment will be described hereafter with reference to FIGS. 29 to 31D.

Figure 29:
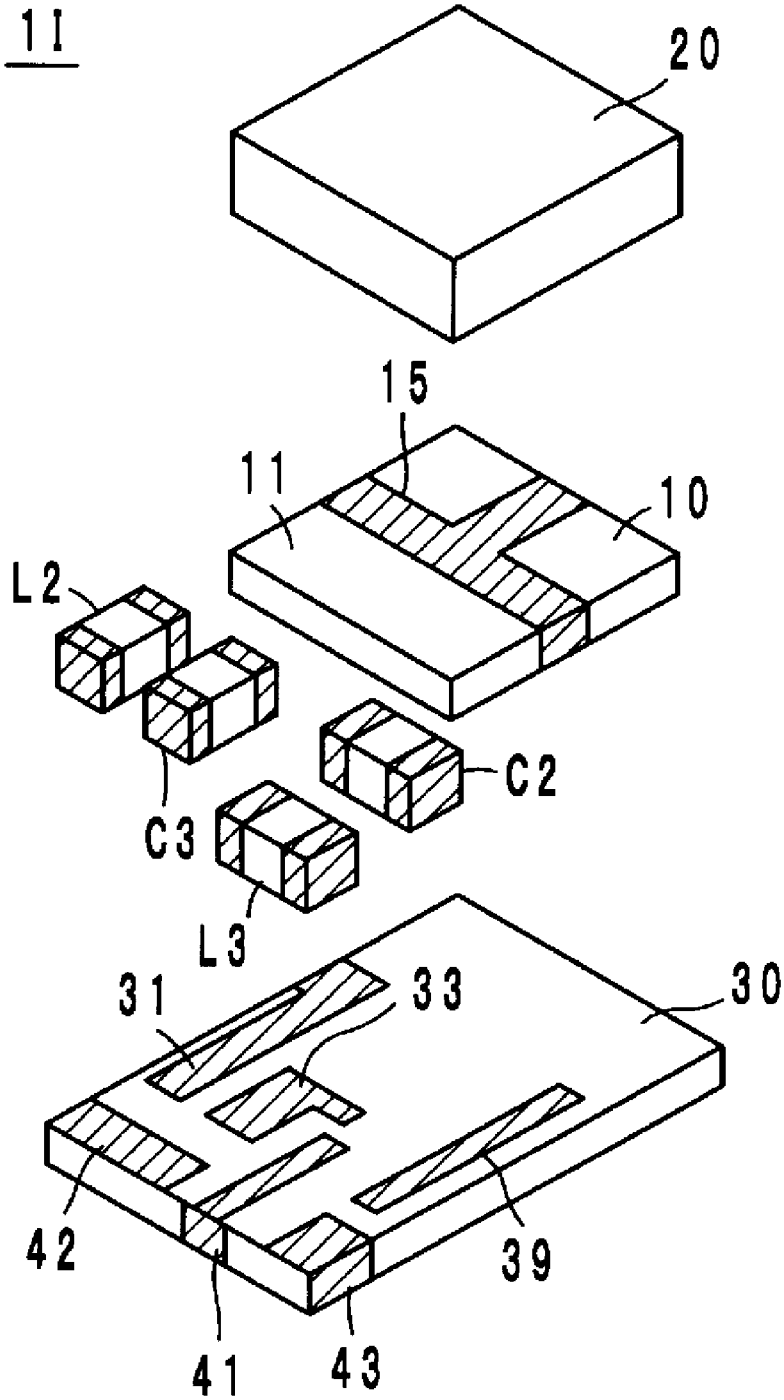
FIG. 29 is an exploded perspective view illustrating a magnetic resonance type isolator according to a ninth preferred embodiment of the present invention.
Figure 30:
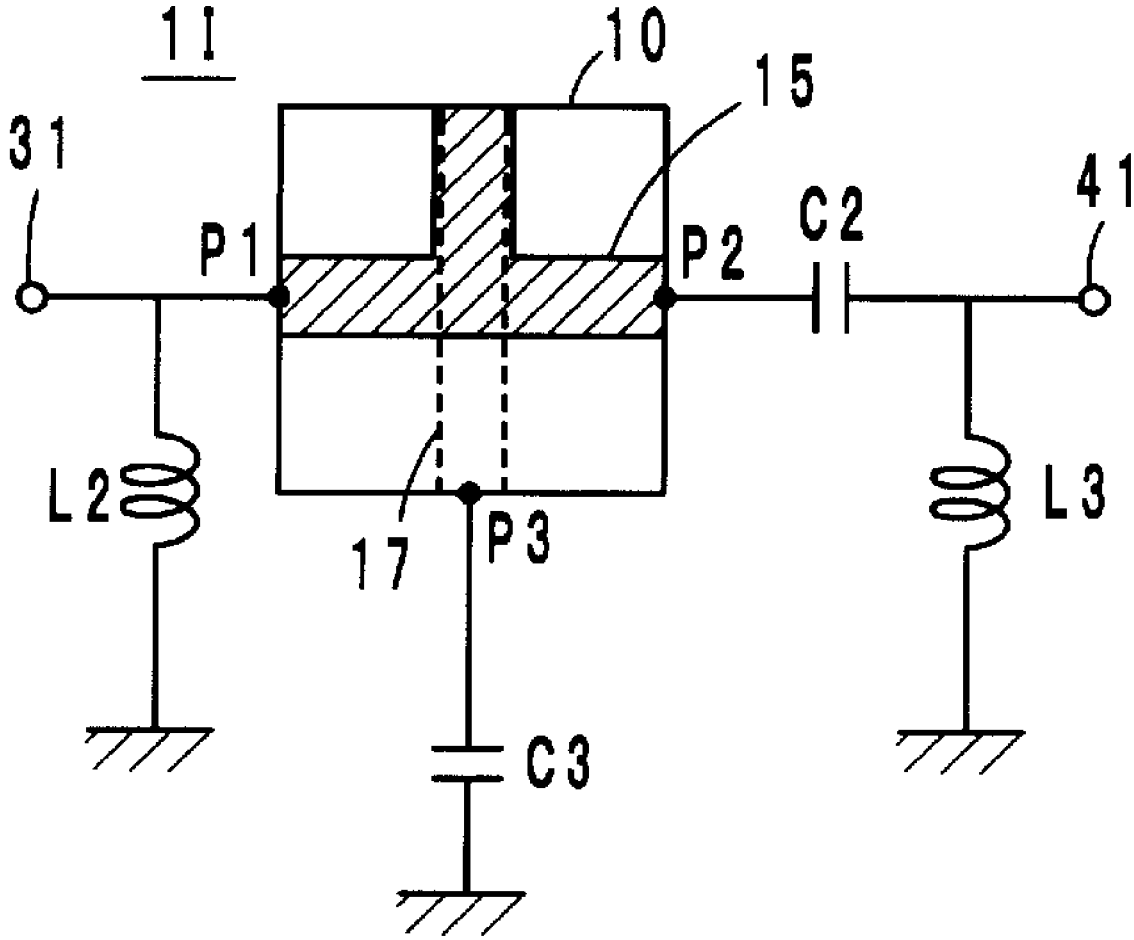
FIG. 30 is an equivalent circuit diagram of the magnetic resonance type isolator according to the ninth preferred embodiment of the present invention.
Figure 31A:
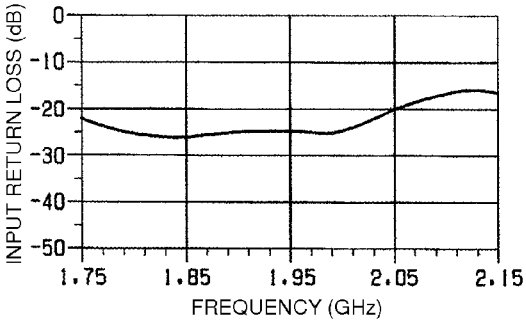
FIGS. 31A-31D are graphs illustrating characteristics of the magnetic resonance type isolator according to the ninth preferred embodiment of the present invention.
Figure 31B:
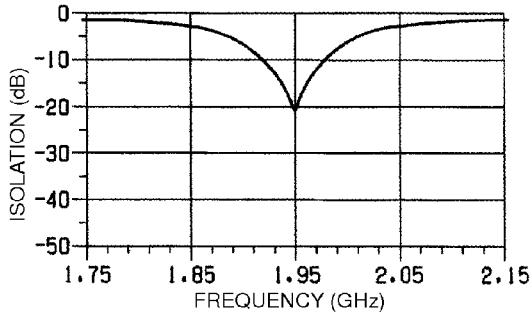
Figure 31C:
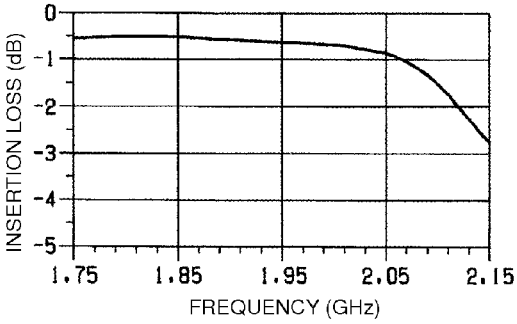
Figure 31D:
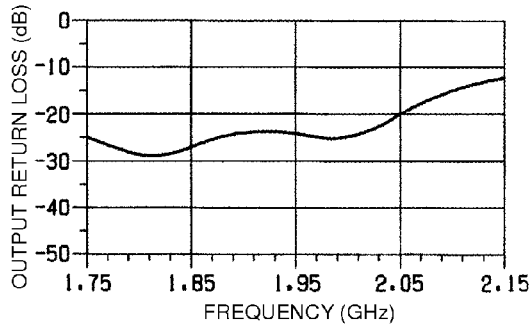

In the magnetic resonance type isolator 1I according to the ninth preferred embodiment, in contrast to the magnetic isolator type isolator 1E according to the fifth preferred embodiment (refer to FIG. 17), as illustrated in FIG. 30, the capacitor C2 is connected in series between the second port P2 and the output terminal electrode 41 and a matching circuit on the output side includes the capacitor C2 and the inductor L3. As illustrated in FIG. 29, the input terminal electrode 31, the output terminal electrode 41, the ground terminal electrodes 42 and 43, and the relay terminal electrodes 33 and 39 are provided on the mounting substrate 30. The rest of the configuration preferably is the same as that of the first preferred embodiment.

One end of the main line (first port P1) is connected to the input terminal electrode 31 and is connected to the ground terminal electrode 42 through the inductor L2. The other end of the main line (second port P2) is connected to the output terminal electrode 41 through the relay terminal electrode 39 and the capacitor C2 and the output port is connected to the ground terminal electrode 43 through the inductor L3. An end portion of the sub-line (third port P3) is connected to the ground terminal electrode 42 through the relay terminal electrode 33 and the capacitor C3.

The operational advantages of the ninth preferred embodiment are basically the same as those of the first preferred embodiment. The input return loss, isolation, insertion loss and output return loss of the magnetic resonance type isolator 1I of the ninth preferred embodiment are illustrated in FIGS. 31A, 31B, 31C and 31D, respectively. The capacitance of the capacitor C3 preferably is about 3.0 pF, the inductance of the inductor L2 preferably is about 6.2 nH, the capacitance of the capacitor C2 preferably is about 5.4 pF and the inductance of the inductor L3 preferably is about 3.7 nH, for example. The impedance of the input port preferably is about 25Ω, the impedance of the output port preferably is about 50Ω and the electrical characteristics have been normalized preferably using an input of about 25Ω and an output of about 50Ω, for example. The insertion loss preferably is about 0.63 dB and the isolation preferably is about 9.6 dB preferably in the range of about 1920 MHz to about 1980 MHz, for example. The size and the like of the ferrite 10 are preferably the same as those of the ferrite 10 in the first preferred embodiment.

In particular, in the ninth preferred embodiment, the impedances of the input port and the output port are different and there is an impedance conversion function. The advantage due to this point is the same as that of the fourth preferred embodiment. Furthermore, since the impedance of the second port P2 is about 50Ω, there is no need for an impedance conversion circuit on the output side.

Tenth to Fifteenth Preferred Embodiments

Magnetic resonance type isolators 1J to 10 according to respective tenth to fifteenth preferred embodiments will be described hereafter with reference to FIGS. 32A-32F.

Figure 32A:
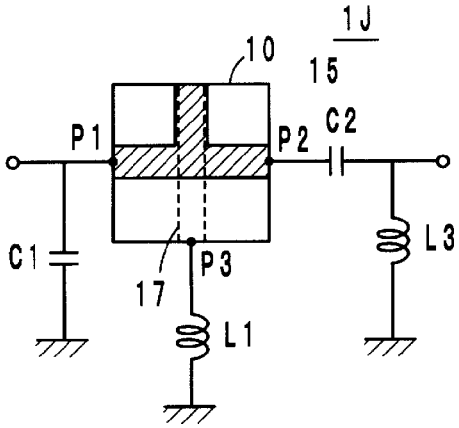
FIGS. 32A-32F are equivalent circuit diagrams of a magnetic resonance type isolator according to any of tenth to fifteenth preferred embodiments of the present invention.

In the magnetic resonance type isolator 1J according to the tenth preferred embodiment, as illustrated in FIG. 32A, the inductor L1 is preferably used as a reactance element connected to an end portion of the sub-line (third port P3), the capacitor C1, which is connected to the ground, is connected between an end of the main line (first port P1) and the input port, the capacitor C2 is connected in series between the other end of the main line (second port P2) and the output port, and the inductor L3, which is connected to the ground, is connected to the output port. The operational advantages of this preferred embodiment are basically the same as those of the eighth preferred embodiment.

Figure 32B:
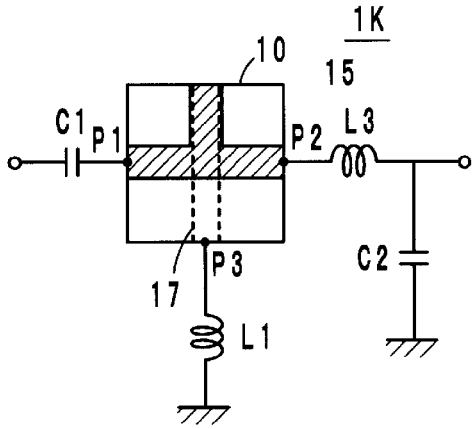

In the magnetic resonance type isolator 1K according to the eleventh preferred embodiment, as illustrated in FIG. 32B, the inductor L1 is preferably used as a reactance element connected to an end portion of the sub-line (third port P3), the capacitor C1 is connected in series between an end of the main line (first port P1) and the input port, the inductor L3 is connected in series between the other end of the main line (second port P2) and the output port, and the capacitor C2, which is connected to the ground, is connected to the output port. The operational advantages of this preferred embodiment are basically the same as those of the eighth preferred embodiment.

Figure 32C:
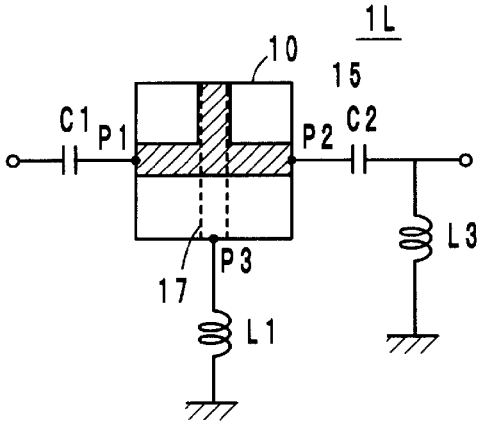

In the magnetic resonance type isolator 1L according to the twelfth preferred embodiment, as illustrated in FIG. 32C, the inductor L1 is preferably used as a reactance element connected to an end portion of the sub-line (third port P3), the capacitor C1 is connected in series between an end of the main line (first port P1) and the input port, the capacitor C2 is connected in series between the other end of the main line (second port P2) and the output port, and the inductor L3, which is connected to the ground, is connected to the output port. The operational advantages of this preferred embodiment are basically the same as those of the eighth preferred embodiment.

Figure 32D:
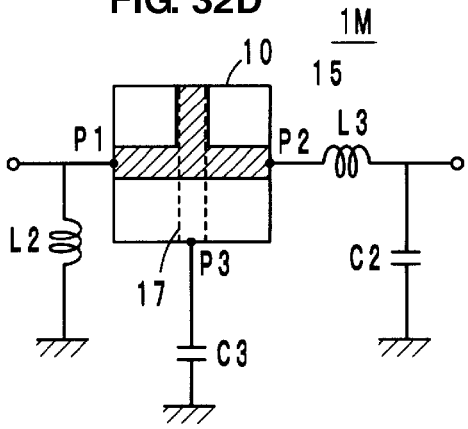

In the magnetic resonance type isolator 1M according to the thirteenth preferred embodiment, as illustrated in FIG. 32D, the capacitor C3 is preferably used as a reactance element connected to an end portion of the sub-line (third port P3), the inductor L2, which is connected to the ground, is connected between an end of the main line (first port P1) and the input port, the inductor L3 is connected in series between the other end of the main line (second port P2) and the output port, and the capacitor C2, which is connected to the ground, is connected to the output port. The operational advantages of this preferred embodiment are basically the same as those of the ninth preferred embodiment.

Figure 32E:
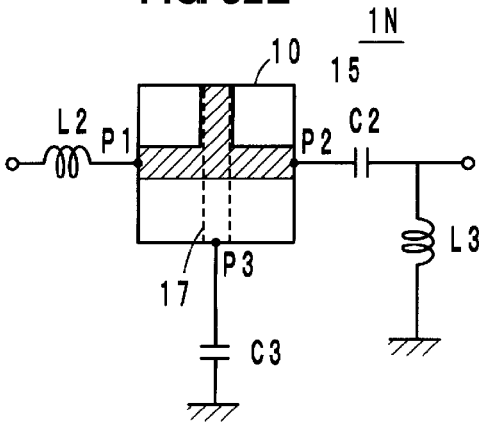

In the magnetic resonance type isolator 1N according to the fourteenth preferred embodiment, as illustrated in FIG. 32E, the capacitor C3 is preferably used as a reactance element connected to an end portion of the sub-line (third port P3), the inductor L2 is connected in series between an end of the main line (first port P1) and the input port, the capacitor C2 is connected in series between the other end of the main line (second port P2) and the output port, and the inductor L3, which is connected to the ground, is connected to the output port. The operational advantages of this preferred embodiment are basically the same as those of the ninth preferred embodiment.

Figure 32F:
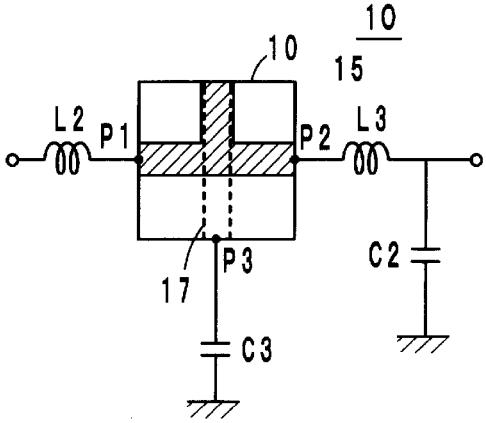

In the magnetic resonance type isolator 10 according to the fifteenth preferred embodiment, as illustrated in FIG. 32F, the capacitor C3 is preferably used as a reactance element connected to an end portion of the sub-line (third port P3), the inductor L2 is connected in series between an end of the main line (first port P1) and the input port, the inductor L3 is connected in series between the other end of the main line (second port P2) and the output port, and the capacitor C2, which is connected to the ground, is connected to the output port. The operational advantages of this preferred embodiment are basically the same as those of the ninth preferred embodiment.

Other Preferred Embodiments

Magnetic resonance type isolators according to the present invention are not limited to the above-described preferred embodiments and can be modified within the scope of the invention.

For example, the connection conductor does not necessarily have to include an inverted T shape and the angle of the intersection may be somewhat larger than or smaller than 90° Furthermore, the size, shape, structure and the like of the mounting substrate may be appropriately chosen.

As described above, preferred embodiments of the present invention are useful for magnetic resonance type isolators, for example, and are particularly excellent in that size reduction and a low impedance can be achieved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A magnetic resonance type isolator comprising:

a ferrite;

a connection conductor that is arranged on the ferrite and includes a first port, a second port and a third port; and a permanent magnet that applies a direct current magnetic field to the ferrite; wherein a main line arranged between the first port and the second port of the connection conductor does not resonate, an end portion of a sub-line that branches from the main line serves as the third port, a reactance element is connected to the third port and the reactance element is connected to the ground; and an impedance matching circuit is connected to the first port and the second port.

2. The magnetic resonance type isolator according to claim 1, wherein the reactance element is an inductance element and a capacitance element is connected to the first port and the second port.

3. The magnetic resonance type isolator according to claim 1, wherein the reactance element is a capacitance element and an inductance element is connected to the first port and the second port.

4. The magnetic resonance type isolator according to claim 1, wherein the reactance element is an inductance element and a capacitance element is connected in series between the first port and an input port and a capacitance element, which is connected to the ground, is connected between the second port and an output port.

5. The magnetic resonance type isolator according to claim 1, wherein the reactance element is a capacitance element and an inductance element is connected in series between the first port and an input port and an inductance element, which is connected to the ground, is connected between the second port and an output port.

6. The magnetic resonance type isolator according to claim 1, wherein the reactance element is an inductance element and a capacitance element is connected between the first port and an input port and a matching circuit composed of an inductance element and a capacitance element is connected between the second port and an output port.

7. The magnetic resonance type isolator according to claim 1, wherein the reactance element is a capacitance element and an inductance element is connected between the first port and an input port and a matching circuit composed of an inductance element and a capacitance element is connected between the second port and an output port.

8. A magnetic resonance type isolator comprising:

a ferrite including a first main surface and a second main surface that oppose each other;

a connection conductor that is arranged on the first main surface of the ferrite and includes a first port, a second port and a third port; and a permanent magnet that applies a direct current magnetic field to the ferrite; wherein a main line arranged between the first port and the second port of the connection conductor does not resonate, a sub-line that branches from the main line serves as an opposing conductor that extends in a direction perpendicular or substantially perpendicular to the main line on the second main surface side, an end portion of the opposing conductor serves as the third port, a reactance element is connected to the third port and the reactance element is connected to the ground; and an impedance matching circuit is connected to the first port and the second port.

* * * * *